United States Patent [19]

Gross

[11] 4,287,805

[45] Sep. 8, 1981

[54] DIGITAL ENVELOPE MODULATOR FOR DIGITAL WAVEFORM

[75] Inventor: Glenn Gross, Chicago, Ill.

[73] Assignee: Norlin Industries, Inc., Deerfield, Ill.

[21] Appl. No.: 144,287

[22] Filed: Apr. 28, 1980

[51] Int. Cl.[3] ..... G10H 1/02

[52] U.S. Cl. ..... 84/1.26; 84/1.13

[58] Field of Search ..... 84/1.26, 1.13, 1.01; 364/722

[56] References Cited

U.S. PATENT DOCUMENTS

| | | | |
|---|---|---|---|
| 3,515,792 | 6/1970 | Deutsch | 84/1.03 |
| 3,610,805 | 10/1971 | Watson et al. | 84/1.13 |
| 4,031,377 | 6/1977 | Deutsch et al. | 364/757 |
| 4,079,650 | 3/1978 | Deutsch et al. | 84/1.26 |
| 4,135,424 | 1/1979 | Okamoto | 84/1.26 |
| 4,144,789 | 3/1979 | Deutsch | 84/1.24 |
| 4,154,133 | 5/1979 | Kitawaga | 84/1.26 |
| 4,185,532 | 1/1980 | Hiyoshi et al. | 364/722 |
| 4,205,575 | 6/1980 | Hoskinson et al. | 84/1.26 |

*Primary Examiner*—J. V. Truhe
*Assistant Examiner*—Forester W. Isen
*Attorney, Agent, or Firm*—Ronald J. Kransdorf; Jack Kail

[57] ABSTRACT

An envelope is imposed on a sequence of binary waveform samples representing a musical waveform signal by repetitively summing selected ones of a group of scaled representations of each of the waveform samples of the form $A/2^m$, $A/2^{m+1} \ldots A/2^{m+p}$, where A represents the magnitude of the waveform sample, p is a predetermined integer, and m is an integer changing by a factor of unity each time a predetermined number of the groups have been developed. The sum of each group of scaled representations differs from the sum of the preceding group by the factor $A/2^{m+p}$ whereby a staircase signal is produced amplitude modulating the musical waveform signal, the step size of the staircase signal charging each time said predetermined number of groups have been developed.

39 Claims, 20 Drawing Figures

| Mux SELECT INPUT | OUTPUT OF COUNTER 72 COUPLED TO LINE 38 |
|---|---|
| 0 0 0 | 1 |
| 0 0 1 | $Q_4$ |
| 0 1 0 | $Q_3$ |
| 0 1 1 | $Q_2$ |
| 1 0 0 | $Q_1$ |
FIG. 8
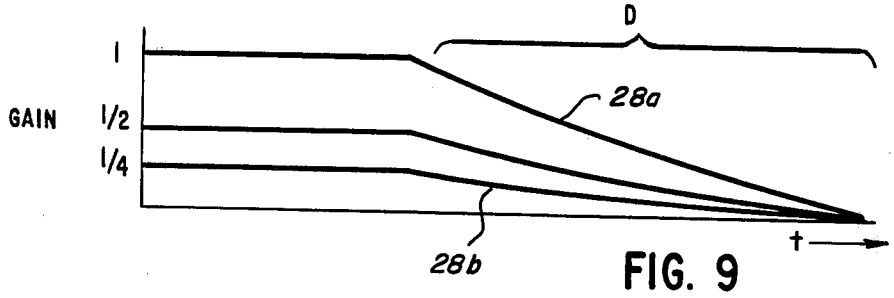
FIG. 9
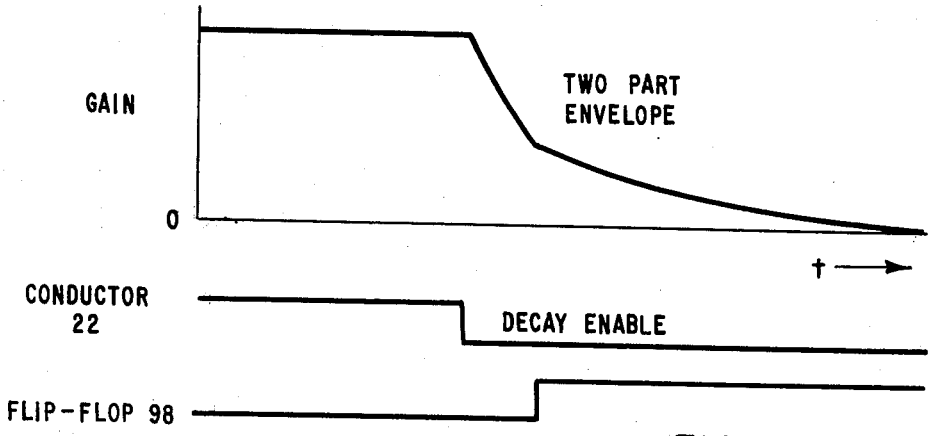
FIG. 10

INITIAL DECAY CODE
FINAL DECAY CODE
SNUB DELAY CODE
SELECTOR
SELECT
CLK
PROGRAM-MABLE DIVIDER
ATTACK
SELECT
SELECTOR
PROGRAM-MED DIVIDER
TO MULTIPLEXER STROBE INPUT
CLK UP/DOWN COUNTER U/D
CLK UP/DOWN COUNTER W/D
RATE MULTIPLE
FROM ADDER 80 CARRY
TO MULTIPLEXER 70
TO ADDER 80
COMPARA-TOR
COMPARA-TOR
COMPLI-MENT
PEAK LEVEL CODE
KEY DOWN 210
212
214
208
178
176
154
88
166
152
174
150
168
170
172
171
173
186
158
156
206

DIGITAL ENVELOPE MODULATOR FOR DIGITAL WAVEFORM

BACKGROUND OF THE INVENTION

The present invention concerns improvements in the field of electronic musical instruments and, in particular, relates to an envelope modulator configured for imposing an envelope on a digitally generated musical waveform.

The tonal characteristics of the audible sounds produced by an electronic musical instrument are greatly enhanced by imposing a suitable envelope on the musical signal waveform produced by the tone generators of the instrument. In essence, a relatively constant level musical signal waveform is amplitude modulated in accordance with a selected envelope function in order to closely simulate the effects of an acoustical musical instrument. Most frequently, the modulation function includes a rising attack portion, which may be either linear or logarithmic, a constant level sustain portion and a falling decay portion which is usually logarithmic in nature and may have more than one decay rate.

In electronic musical instruments of the type having tone generation systems wherein a musical waveform is stored in a binary memory in sampled form and retrieved therefrom by a suitably arranged addressing system, the amplitude modulated waveform signal is normally derived by multiplying the stored waveform samples with a digitally stored representation of the desired envelope modulation. Conventional multiplication circuits used for this purpose require a number of clock periods corresponding to the bit size of the stored signals in which to complete a multiplication calculation. Since, in order to achieve adequate resolution, the bit size of the stored waveform and envelope samples is usually relatively large, e.g. on the order of 12 bits, it will be apparent that each multiplication calculation will require a relatively long period of time to complete. In view of the fact that signal processing in an electronic musical instrument must be carried out in real time, these long multiplication times are considered quite undesirable.

It is accordingly a basic object of the invention to provide an envelope generator for an electronic musical instrument adapted for imposing a selected envelope on a sequence of binary waveform samples, the envelope generator operating at a relatively fast speed without any degredation of accuracy in relation to slower prior art circuits.

It is a further object of the invention to provide such an envelope generator in which the step size of the output amplitude modulated binary signal is proportional to the signal level for maintaining the step noise nearly constant. Other objects of the invention include the provision of means allowing for adjustment of the initial gain or peak level of the envelope for controlling volume, adjustment of the attack and decay times of the envelope and adjustment of the character or shape of the envelope for creating different musical effects. Yet another object of the invention resides in the provision of an envelope generator wherein the attack and decay times are independent of the initial gain or peak level of the envelope modulation.

SUMMARY OF THE INVENTION

In accordance with the foregoing and other useful objects, the present invention provides an improved apparatus and method for imposing an envelope on a plurality of sequentially generated binary waveform samples representing a musical waveform signal. Each of the binary waveform samples is applied, in turn, to the input of a programmable right-shift scaler which is operated in response thereto for producing a selected group of scaled representations of the binary waveform sample. The groups of scaled representations of the binary waveform samples are sequentially applied to an output circuit which forms the sum of each group for producing an amplitude modulated multistep staircase signal representing the sequence of binary waveform samples modified by a selected envelope. The scaler is operated such that each group of scaled representations of the binary waveform samples includes one or more of the expressions $A/2^m$, $A/2^{m+1}$, . . . $A/2^{m+p}$, where A represents the magnitude of the waveform sample, p is a predetermined integer less than the bit size of the waveform samples and m is an integer which changes by a factor of unity each time a predetermined number of the groups, corresponding to a respective segment of the output staircase signal, have been developed. The scaler is further operated such that the sum of the scaled representations of each group differs from the sum of the last preceding non-identical group by the expression $A/2^{m+p}$ whereby, the step size of the output staircase signal is constant for each segment thereof but changes by a factor of one-half for each succeeding segment. Processing time is significantly reduced since only p binary calculations are performed in response to each waveform sample rather than a number of calculations equal to the bit size of the samples.

BRIEF DESCRIPTION OF THE DRAWINGS

FIG. 8 is a logic table illustrating the operation of the multiplexer 70 of FIG. 7.

FIG. 9 graphically illustrates the decay time compensation effect achieved by the circuit of FIG. 7 for different gain settings.

FIG. 10 illustrates a two part decaying envelope generated by the envelope generator of FIG. 1.

DESCRIPTION OF THE PREFERRED EMBODIMENT

Figure 1:
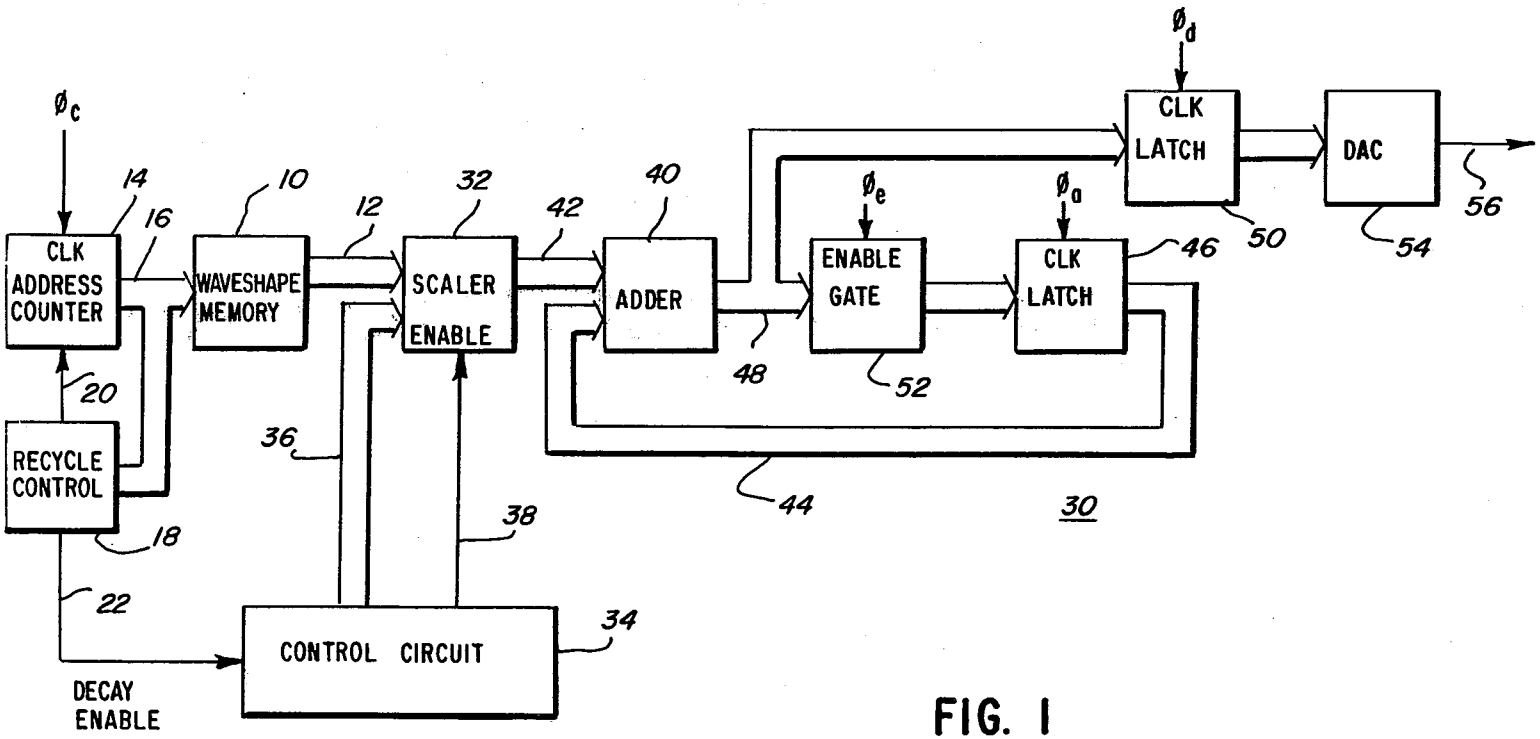
FIG. 1 is a block diagram generally illustrating the envelope generator of the invention in association with a waveshape memory device.

Referring now to the drawings, a basic embodiment of the envelope generator of the invention is shown generally in FIG. 1. The illustrated generator is adapted for imposing an envelope on a digitally generated waveform in order to give the waveform an attack and a decay characteristic, or a decay characteristic alone, typical of a natural acoustical sound. The digitally generated waveform is produced on an output bus 12 of a waveshape memory 10. The waveshape memory 10, which stores a plurality of waveform sample points at a plurality of discrete memory locations, is addressed by an address counter 14 through an address bus 16. In the embodiment illustrated in FIG. 1, the address bus 16 is also coupled to the input of a recycle control circuit 18 which includes an output control line 20 connected to the address counter 14 and a decay enable output line 22.

Figure 2:
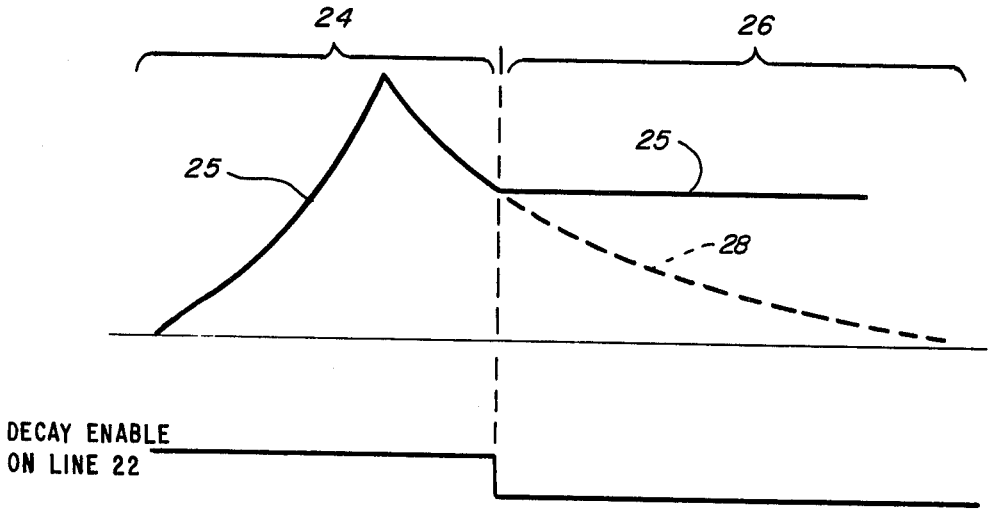
FIG. 2 graphically illustrates the manner in which the envelope generator of FIG. 1 imposes a decay envelope on the output of the waveshape memory device.

Application Ser. No. 144,286, entitled Long Duration Aperiodic Musical Waveform Generator, filed concurrently herewith, and assigned to the assignee of the present invention, illustrates in detail the operation of a digital waveform generator embodying the functional elements mentioned above, said application being incorporated herein by reference. Briefly, the address counter 14, which is clocked by a clock signal $\phi_c$ initially addresses a first portion of the memory locations of the waveshape memory 10 which, in response thereto, develops on the output bus 12 a sequence of waveform samples characterized by a selected attack modulation. After the address counter 14 reaches a predetermined address, the recycle control circuit 18 causes the address counter 14 to access a second portion of the memory locations of the waveshape memory 10 in a recirculating mode so that a continuously repeating sequence of waveform sample points having a fixed average level is developed on the output bus 12. FIG. 2 diagrammatically illustrates the digital waveform signal generated on the output bus 12. It will be observed that the waveform, represented by solid line 25, is characterized by an initial transient or attack portion 24 followed by an approximately constant level steady state portion 26. The signal developed on conductor 22 undergoes a logical transition from a high level to a low level at the address of the counter 14 separating the portion 24 from the portion 26.

The envelope modulator shown in FIG. 1 is adapted for applying an exponential decay to the recycled portion 26 of the digital waveform samples developed on the output bus 12. The effect of applying such a decay envelope is illustrated by the decaying dotted line 28 in FIG. 2. Also, it is to be understood that the present invention is not limited to a digital tone generator employing an addressed memory but is operable in association with any tone generation system providing a sequence of binary waveform samples including, for example, a system wherein the waveform samples are produced at the output of a suitably operated binary counter.

Referring back to FIG. 1, the exponential decay represented by dotted line 28 is imposed on the recycled portion 26 of the waveform samples developed on output bus 12 by the envelope generator shown generally at 30. The generator 30 includes a programmable right-shift scaler 32 having a data input coupled to the bus 12 and a program input supplied from a control circuit 34 by a bus 36. The control circuit 34 also includes an output conductor 38 connected to the enable input of the scaler 32. The scaler 32 is a conventional circuit which, when enabled, shifts the data presented on bus 12 a number of places to the right depending on the value of the binary signal coupled to its program input.

The output of the scaler 32, representing shifted waveform sample data, is coupled to one input of a binary adder 40 by a bus 42, the adder 40 being supplied with a second input developed on a bus 44 and representing the output of a latch 46 operated by a clock signal $\phi_a$. The output of the adder 40 is coupled by a bus 48 to the input of a second latch 50, operated by a clock signal $\phi_d$, and through a gate 52, enabled by a clock signal $\phi_e$, to the input of the latch 46. The output of the latch 50 is coupled to a digital to analog converter 54 on whose output 56 is developed an analog representation of the modulated waveform as shown in FIG. 2.

Figure 3:
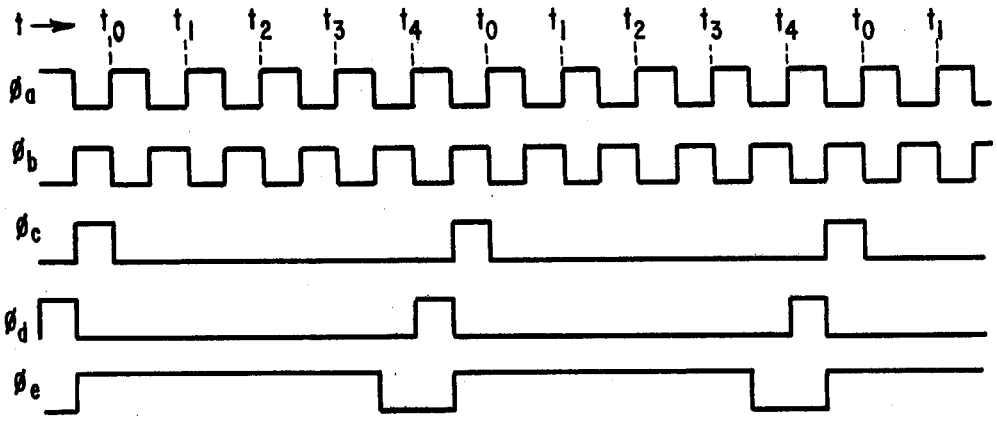
FIG. 3 graphically illustrates a series of timing signals used to operate the envelope generator of FIG. 1.
Figure 4:
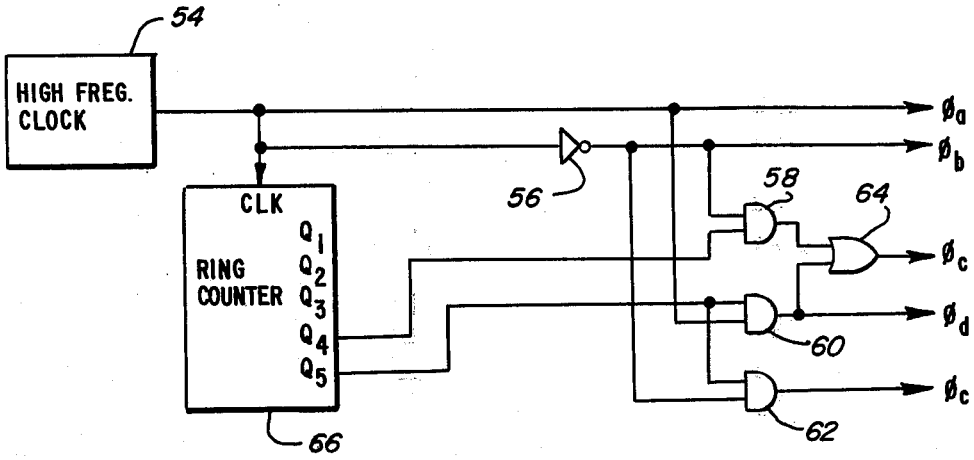
FIG. 4 is a block diagram showing a circuit producing the timing signals of FIG. 3.

The various clock signals operating the circuit of FIG. 1 are shown in FIG. 3 and a circuit adapted for generating these signals is illustrated in FIG. 4. Clock signal $\phi_a$ is derived from the output of a high frequency clock 54 while clock signal $\phi_b$ is derived by coupling the output of the clock 54 through an inverter 56. Clock signals $\phi_c$, $\phi_b$ and $\phi_e$ are derived from the outputs of a collection of logic gates including AND gates 58, 60 and 62 and an OR gate 64, the gates 58–64 being operated in response to outputs $Q_4$ and $Q_5$ of a five stage ring counter 66 as well as the output of clock 54.

Figure 5:
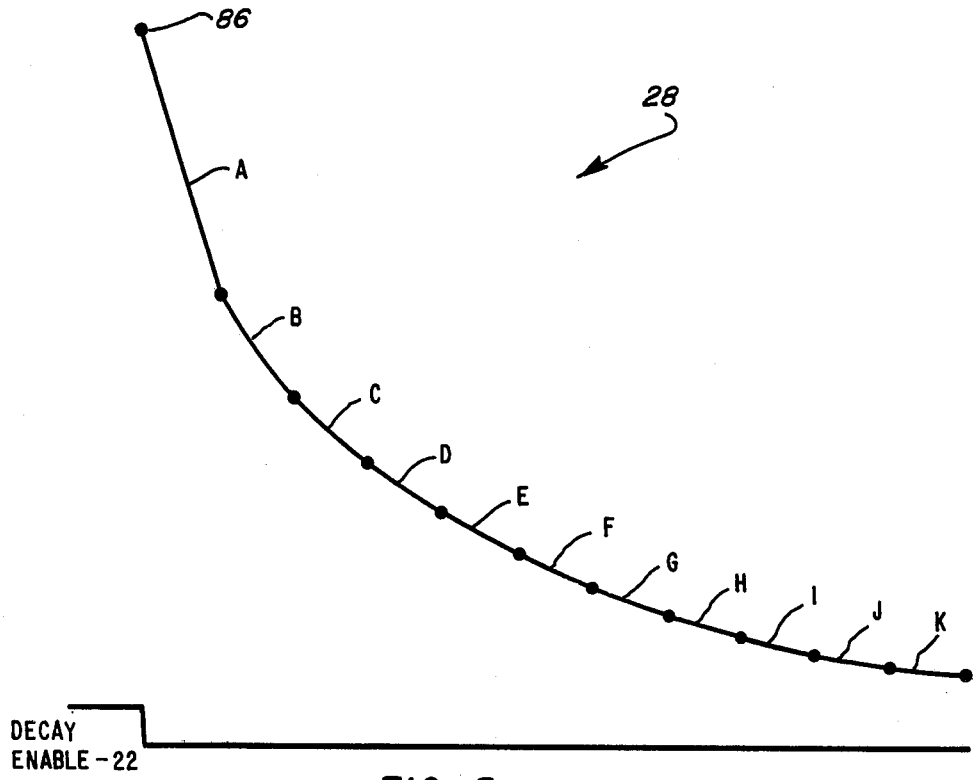
FIG. 5 graphically depicts the decay envelope produced by the envelope generator of FIG. 1.
Figure 6:
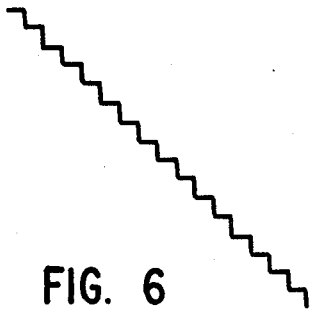
FIG. 6 is a graphical representation of the staircase signal forming one segment of the decay envelope of FIG. 5.

The operation of the circuit of FIG. 1 will now be generally described with the aid of the waveform diagram of FIG. 5. As shown in FIG. 5, the decaying exponential envelope imposed on the waveform samples developed at the output of the waveshape memory 10 by the envelope generator 30 is approximated by eleven linear piecewise segments A–K. Each of the eleven segments A–K is composed of a staircase signal consisting of sixteen equal steps, FIG. 6 illustrating segment A in enlarged form, the slope of each segment being one-half of the slope of the preceding segment. The step size of the sixteen step staircase signal forming each of the eleven segments A–K, which step size decreases by a factor of one-half for each succeeding segment, is derived by the envelope generator 30 of FIG. 1 as explained below.

Before proceeding with a detailed explanation of the operation of the envelope generator 30, it may be helpful to initially consider its operation on a conceptual level. For purposes of simplicity and clarity it will hereinafter be assumed that the amplitude of the waveform samples produced by the memory 10 during the recirculating portion 26 remains substantially constant at a level of unity. Considering initially the first segment A of the decaying exponential envelope 28, the amplitude of the initial step comprising the segment is derived by summing the amplitude expressions $\frac{1}{2}$, $\frac{1}{4}$, $\frac{1}{8}$, 1/16 and 1/32. It will be appreciated that these amplitude expressions are available at the output of the scaler 32 and represent an input waveform sample shifted one, two, three, four and five places to the right respectively. The amplitude of the next step of segment A is formed by adding the amplitude expressions $\frac{1}{2}$, $\frac{1}{4}$, $\frac{1}{8}$ and 1/16 and by dropping the 1/32 amplitude expression from the initial calculation. The amplitude of the third step is formed by adding the amplitude expressions $\frac{1}{2}$, $\frac{1}{4}$, $\frac{1}{8}$ and 1/32 and by dropping the expression 1/16 from the previous calculation. This addition process is sequentially repeated sixteen times whereby a sixteen step staircase signal having a step size equal to 1/32 is produced as shown in FIG. 6. In this regard, it will be observed that the amplitude of the final step in the staircase signal of segment A will have a value equal to $\frac{1}{2}$.

The amplitude of the first step of the second segment B is derived by adding the amplitude expressions $\frac{1}{4}$, $\frac{1}{8}$, 1/16, 1/32 and 1/64 which also represent shifted waveform samples developed at the output of the scaler 32. The amplitudes of succeeding steps in the second segment B are formed in a manner similar to that described above with relation to the first segment except that each succeeding summation decreases by a value of 1/64 rather than 1/32. As a result, the second segment B is characterized by a sixteen step staircase signal extending between the amplitudes $\frac{1}{2}$ and $\frac{1}{4}$ in equal step sizes of 1/64 and is characterized by a slope one-half that of segment A. The staircase signals for the succeeding segments C–K are calculated in an analogous manner with the step size decreasing by a factor of two for each succeeding segment although being maintained at the constant value of any given segment. The term "group" will be used hereinafter in the specification and the claims to describe the amplitude expressions summed together to calculate a step amplitude. A group may therefore contain a maximum of five amplitude expressions, e.g. $\frac{1}{2}$, $\frac{1}{4}$, $\frac{1}{8}$, 1/16 and 1/32, and a minimum of one amplitude expression, e.g. $\frac{1}{2}$. Regardless of the number of amplitude expressions forming a group, each group is formed and the associated step amplitude is calculated in a time interval of five clock periods, one clock period being alloted for each of the five possible expressions of the group. By the technique of offsetting the shifted amplitude expressions in succeeding segments by a factor of one-half, i.e. in initial expression in each group of segment A being $\frac{1}{2}$, the initial expression in each group of segment B being $\frac{1}{4}$, and so on, the resulting staircase signal approximates a signal having 12 bit resolution but requiring only a five clock period calculation interval.

The foregoing effect is realized by the envelope generator 30 of FIG. 1 as follows. Initially, assuming that the decay enable signal on conductor 22 has gone logically low, a unity value waveform sample is read from the waveshape memory 10 in response to a $\phi_c$ clock pulse. The amplitude sample is coupled to the input of the scaler 32 which is enabled by the control circuit 34 and also programmed to shift the amplitude sample one place to the right. The output of the scaler 32 coupled to the adder 40 therefore represents an amplitude of $\frac{1}{2}$. Since the output of the latch 46 is initially 0, the output of the adder 40 also represents an amplitude of $\frac{1}{2}$ and is coupled through the gate 52, which is enabled by clock signal $\phi_e$. In response to the rising edge of clock signal $\phi_a$ at time $t_0$, see FIG. 3, the amplitude expression $\frac{1}{2}$ is stored in the latch 46 and coupled therefrom to the second input of the adder 40. In response to the next occurring rising edge of clock signal $\phi_b$, the scaler 32 is again enabled and programmed for shifting the unity value waveform sample on bus 12 two places to the right for coupling a signal amplitude of $\frac{1}{4}$ to the first input of the adder 40. The output of the adder is therefore $\frac{1}{4}$ plus $\frac{1}{2}$ which is again coupled through enable gate 52 and stored in latch 46 at time $t_1$. The next occurring rising edge of clock signal $\phi_b$ again enables the scaler 32 which is programmed to shift the waveform amplitude on bus 12 three places to the right so that the output of the scaler represents an amplitude of $\frac{1}{8}$. The output of the adder 40 therefore now represents an amplitude of $\frac{1}{2}$ plus $\frac{1}{4}$ plus $\frac{1}{8}$, this signal amplitude being again coupled through enabled gate 52 and stored in latch 46 at time $t_2$. This process is again repeated, i.e. the scaler 32 being enabled and programmed for introducing a right shift of four places, whereby the amplitude value $\frac{1}{2}$ plus $\frac{1}{4}$ plus $\frac{1}{8}$ plus 1/16 is stored in latch 46 at time $t_3$. In the final step of the calculation, the scaler is enabled and programmed for introducing a right shift of five places so that an amplitude value of 1/32 is added by the adder 40 to the previous output of the latch 46, i.e. $\frac{1}{2}$ plus $\frac{1}{4}$ plus $\frac{1}{8}$ plus 1/16. However, just prior to time $t_4$ the gate 52 is disabled by clock signal $\phi_e$ so that the output of the adder 40 cannot be coupled to the latch 46. But, at time $t_4$ the latch 50 is clocked by clock signal $\phi_d$ for storing the amplitude value $\frac{1}{2}$ plus $\frac{1}{4}$ plus $\frac{1}{8}$ plus 1/16 plus 1/32. The output of latch 50 is then coupled to digital to analog converter 54 for developing the output signal.

The next occurring $\phi_c$ clock pulse causes another unity value waveform sample to be read from the waveshape memory 10. A five step process similar to that described above is repeated except that the scaler is not enabled during the last step. Therefore, in response to the clock pulse $\phi_d$ occurring at time $t_4$ the latch 50 is clocked for storing the amplitude value $\frac{1}{2}$ plus $\frac{1}{4}$ plus $\frac{1}{8}$ plus 1/16 plus 0. During the next cycle the scaler is not enabled during the second to the last step whereby an amplitude value of $\frac{1}{2}$ plus $\frac{1}{4}$ plus $\frac{1}{8}$ plus 0 plus 1/32 is stored in the latch 50. It will therefore be appreciated that each time an amplitude sample is read from the waveshape memory 10 a similar five step calculation is performed whereby a descending staircase signal is developed at the output of the latch 50, each step within the staircase signal having a step size of 1/32.

For subsequent segments a similar process is repeated except that the scaler is programmed by the control circuit 34 for right shifting the amplitude samples on bus 12 one additional place for each succeeding segment. For example, while the scaler 32 is programmed to provide five successive right shifts of one, two, three, four and five places in each step amplitude calculation of segment A, the scaler 32 is programmed for providing five successive right shifts of two, three, four, five and six places in each step amplitude calculation in segment B. As a result, each step in segment B is formed by selectively adding one or more of the amplitudes $\frac{1}{4}$, $\frac{1}{8}$, 1/16, 1/32 and 1/64. Segment B therefore consists of a sixteen step staircase signal extending between amplitude values $\frac{1}{2}$ and $\frac{1}{4}$ with each step size being equal to 1/64. Similarly, the next segment comprises a sixteen step staircase signal which decreases in increments of 1/128, and so on. As a result, the slope of the signal developed at the output of the latch 50 decreases by a factor of $\frac{1}{2}$ for each succeeding segment A–K so that an exponentially shaped envelope signal is generated.

Figure 7:
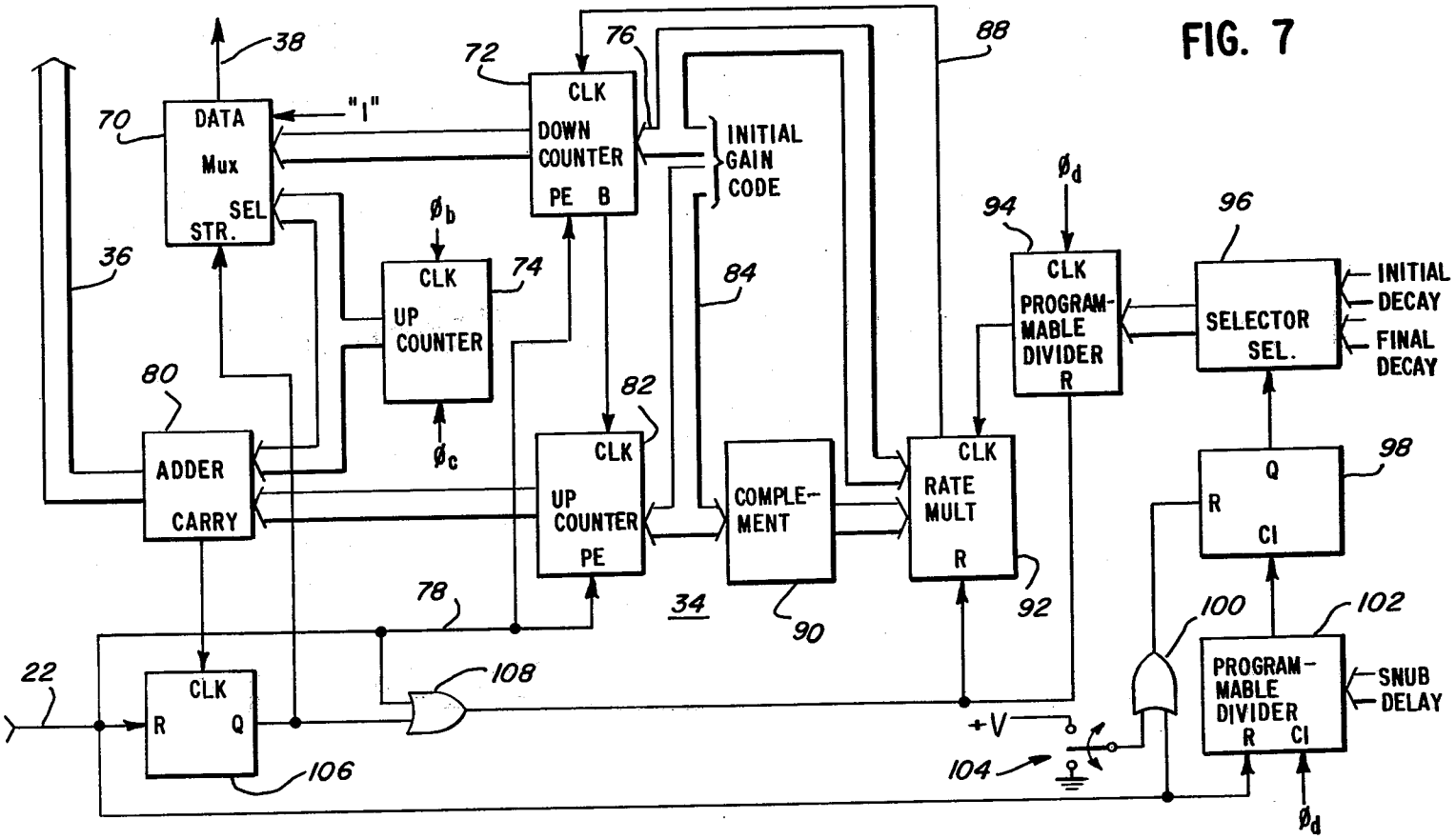
FIG. 7 is a block diagram illustrating an embodiment of the control circuit 34 of FIG. 1 enabling the generation of a decay envelope as shown in FIG. 5.

An embodiment of the control circuit 34 is shown in FIG. 7. The enabling signal for the scaler 32 is developed at the output of a five line to one line multiplexer 70. The five data inputs of the multiplexer 70 are connected with the data input in the most significant position being hard wired to a logical 1 signal source and the remaining four inputs being supplied from the four outputs of a four stage down counter 72. The select input of the multiplexer 70 is supplied with a three bit binary signal developed at the output of an up counter 74, the up counter 74 being clocked by clock signal $\phi_b$ and reset by clock signal $\phi_c$. In operation, the down counter 72 is preset to an initial gain supplied by a bus 76 in response to a logically high preset enable signal on a conductor 78 connected to the decay enable conductor 22. The maximum initial gain of the system is one which corresponds to an initial gain code on bus 76 of 0000. Therefore, assuming that it is desired to preset the system to an initial gain of one, the down counter 72 is preset to 0000. As a consequence, the data inputs of the multiplexer 70 are initially supplied with the five bit binary signal 10000.

The program code supplied to the scaler 32 over bus 36 is developed at the output of an adder 80 of the control circuit 34. One input to the adder 80 is derived from the output of the up counter 74 and the other input from the output of a second up counter 82. The second up counter 82 is clocked by the borrow output of the down counter 72 and preset by an initial gain code developed on a bus 84 in response to a logically high preset enable signal on the conductor 78. In order to achieve a maximum system gain of one, the up counter 82 is also initially set to state 0000.

After the initial attack portion 24 of the waveform samples stored in the waveshape memory 10 has been developed on the bus 12, the decay enable signal on conductor 22 goes low releasing the counters 72 and 82 from their preset state. The next $\phi_c$ clock pulse couples the first waveform sample in the recycled portion 26 (which is assumed to have a value of unity) to the scaler 32 via the bus 12 and also resets the up counter 74. The output of the counter 74 coupled to the select input of the multiplexer 70 and to the first input of the adder 80 is therefore 000. Referring to FIG. 8, the enable output 38 of the multiplexer 70 is consequently logical 1 and the scaler program code developed on bus 36 of the adder 80 is 0000. The scaler 32 is thereby enabled for coupling the waveform sample from the bus 12 to the bus 42 in an unmodified form. In response to the next four $\phi_b$ clock pulses the counter 74 causes the multiplexer 70 to successively couple the outputs $Q_4$, $Q_3$, $Q_2$ and $Q_1$ of the down counter 72 to the conductor 38. Since the down counter 72 has previously been preset to state 0000, four successive logically low signals are developed on the conductor 38 disabling the scaler 32 during the four $\phi_b$ clock pulses. Thus, referring back to the previous discussion of the operation of the circuit of FIG. 1, the initially fetched waveform sample on bus 12 results in latch 50 storing the accumulated signal 1+0+0+0+0. This value corresponds to the initial point 86 of the exponentially decaying envelope 28 shown in FIG. 5.

The foregoing process may be repeated a number of times until a clock pulse is developed on a conductor 88 causing the down counter 72 to decrement to state 1111. In response to this state change, a borrow pulse is developed by the counter 72 clocking the up counter 82 to state 0001. The next occurring $\phi_c$ clock pulse resets the up counter 74 and also fetches the next amplitude sample from the waveshape memory 10. The next five successive $\phi_b$ clock pulses consequently cause multiplexer 70 to successively couple the logic signals 1−1−1−1−1 to the output conductor 38 for successively enabling the scaler 32. During these five successive $\phi_b$ clock pulses the output of the adder 80 successively assumes the states 0001−0010−0011−0100−0101. The scaler 32 is thereby programmed for initially shifting the waveform sample on bus 12 one place to the right followed successively by shifts of 2, 3, 4 and 5 places to the right. Since the scaler 32 is enabled during all five clock periods, the circuit of FIG. 1 is operative for accumulating the sum $\frac{1}{2}+\frac{1}{4}+\frac{1}{8}+1/16+1/32$ and storing this sum in the latch 50. The foregoing represents the calculation of the amplitude of the first step of the sixteen step staircase signal of the segment A shown in FIG. 5.

The next clock pulse developed on the conductor 88 decrements the counter 72 to state 1110, the state of the up counter 82 remaining unchanged. The multiplexer 70 is consequently operated by the up counter 74 for successively producing the signals 1−1−1−1−0 on the output line 38 in response to the next five $\phi_b$ pulses. Therefore the scaler 32 is enabled for the first four clock periods but disabled for the final clock period in the calculation cycle. Since the program code developed on the bus 36 remain unchanged from the previous calculation, the sum accumulated in the latch 50 in response to the next $\phi_d$ clock pulse is $\frac{1}{2}+\frac{1}{4}+\frac{1}{8}+1/16+0$. This accumulated signal represents the amplitude of the second step in the sixteen step staircase signal corresponding to segment A.

The next clock pulse on the conductor 88 causes the down counter 72 to decrement to state 1101, the state of the up counter 82 again remaining unchanged. The enabling signal on the conductor 38 of the multiplexer 70 therefore successively takes on the values 1−1−1−0−1. As a result, the accumulated sum stored in the latch 50 after five $\phi_b$ clock pulses corresponds to $\frac{1}{2}+\frac{1}{4}+\frac{1}{8}+0+1/32$. This values forms the amplitude of the third step in the sixteen step staircase signal corresponding to segment A. This process is continuously repeated as the down counter 72 is decremented in response to clock pulses on the conductor 88 whereby the sixteen step staircase signal corresponding to segment A is produced having a step size of 1/32. In this regard, it will be observed that the amplitude of the final step in the staircase signal corresponding to segment A will be produced when the down counter 72 has been decremented to state 0000, which amplitude is represented by the summation $\frac{1}{2}+0+0+0+0$.

In response to the next clock pulse on the conductor 88 the state of the down counter 72 will transition from 000 to 1111 thereby producing a borrow pulse clocking the up counter 82 to state 010. The system is now placed in condition for forming the sixteen step staircase signal corresponding to segment B of FIG. 5. More particularly, the down counter 72 and the up counter 74 will cooperatively operate the multiplexer 70 for producing enabling signals on the conductor 38 exactly as described with reference to segment A. However, since the state of the up counter 82 is now one count higher, i.e. 0010, the successive outputs of the adder 80 will be correspondingly offset by one unit relative to the outputs produced during the formation of segment A. Therefore, the amplitude of each step forming part of the sixteen step staircase signal corresponding to segment B is produced by accumulating or summing suitable ones of the shifted amplitude expressions $\frac{1}{4}$, $\frac{1}{8}$, 1/16, 1/32 and 1/64 in accordance with the enabling signal developed on the conductor 38. It will thus be observed that a sixteen step staircase signal is formed at the output of latch 50 whose step size is 1/64. The amplitude of the final step in the segment is $\frac{1}{4}$.

The remaining nine segments C-K of the envelope 28 are formed in an identical manner each time a borrow pulse is developed by the down counter 72. It will be seen that the step size decreases by $\frac{1}{2}$ for each successive segment thus producing the exponential curve shown in FIG. 5. It will be observed that the step size of the envelope advantageously remains approximately proportional to the average peak level of the modulated signal as it decays thereby keeping the step noise substantially constant.

It will be recalled that the decay enable signal developed on the conductor 22 remains logically high during the attack portion 24 of the waveform stored in the waveshape memory 10. Since the decay enable signal is coupled to the preset enable inputs of the counters 72 and 82 by the conductor 78, the two counters are held in the preset mode during the attack portion 24 of the waveform. Since the gain of the system is constant in the preset mode, the character of the attack signal is not altered although it may be attenuated by a factor depending upon the setting of the initial gain code.

The gain code coupled to the down counter 72 by bus 76 is also applied to the four least significant program inputs of a rate multiplier 92 while the gain code input coupled to the up counter 82 by bus 84 is also applied to the input of a complementor 90 which couples the complement of the signal developed on bus 84 to the four most significant program inputs of the rate multiplier 92. The rate multiplier 92 together with the complementor 90 serve to compensate the rate of decay of the exponential envelope 28 for different initial gain settings so that the decay time will stay approximately the same even though the initial amplitude of the decay signal has changed. This effect is illustrated in FIG. 9. In particular, it will be observed that even though the initial gain of the system varies considerably, the decay time D remains substantially constant. More specifically, it will be recalled that large values of initial gain, i.e. equal to or approaching unity, correspond to low initial gain codes. The low initial gain codes are complemented by the complementor 90 and used to program the rate multiplier which couples a relatively high frequency clock signal to the conductor 88 from the output of a programmable divider 94. The high frequency clock signal on conductor 88 therefore causes the envelope produced by the generator to decay at a relatively rapid rate as illustrated by curve 28*a* of FIG. 9. Low value initial system gains are, on the other hand, represented by relatively large initial gain codes. The large initial gain codes are complemented by the complementor 90 and coupled as low value program inputs to the rate multiplier 92. The rate multiplier 92 responds to these low value program codes by developing a relatively low frequency clock signal on the conductor 88 in response to the programmable divider 94, which low value clock signal results in a relatively slowly decaying exponential envelope as illustrated by curve 28*b* of FIG. 9.

The programmable divider 94, which is clocked by clock signal $\phi_d$, is, as explained before, used to control the decay time of the envelope signal 28, large divide ratios producing a relatively long decay time and small divide ratios producing a relatively short decay time. While the programmable divider 94 may be programmed for exhibiting a single divide ratio, it is frequently desirable to produce a two part decay envelope as illustrated in FIG. 10. For this purpose, a selector circuit 96 is provided for selectively coupling an initial decay code and a final decay code to the programmable divider 94 in accordance with the state of the logic signal coupled to its select input. The select input of the selector circuit 96 is supplied from the Q output of a flip-flop 98 whose reset input is derived from the output of an OR gate 100 and whose clock input is derived from the output of a second programmable divider 102. One input to the OR gate 100 is derived from the decay enable conductor 22 while its second input is connected to a snub control switch 104. The programmable divider 102, whose divide ratio is set by a snub delay code, is clocked by clock signal $\phi_d$ and reset by the decay enable signal on the conductor 22.

When the snub control switch 104 is in the off position, connected to a source of positive potential, a logical 1 signal will continuously be applied to the reset input of flip-flop 98 through OR gate 100 holding its Q output low. The selector circuit 96 will therefore only couple the initial decay code to the programmable divider 94 whereby a decay envelope characterized by a single decay rate corresponding to the initial decay code is produced. If, however, the snub control switch 104 is moved to its on position, connected to a source of ground potential, the flip-flop 98 will be removed from reset when the decay enable signal on conductor 22 goes logically low. After a predetermined delay determined by the snub delay code, the output of the divider 102 will go high clocking flip-flop 98 and causing a logical 1 signal to be coupled to the select input of the selector circuit 96. The selector circuit 96 will thereby couple the final decay code to the programmable divider 94 causing the decay rate of the envelope to assume a second value.

With further reference to FIG. 7, when the sum of the outputs of up counters 74 and 82 exceeds a value of decimal 15, i.e. when the output of up counter 74 is decimal 4 and the output of up counter 82 is decimal 12, the adder 80 will overflow producing a carry pulse which clocks a flip-flop 106. The Q output of the flip-flop 106 therefore switches logically high at the end of the envelope 28, the logically high signal being coupled through an OR gate 108 for resetting the rate multiplier 92 and the programmable divider 94. The logically high Q output of flip-flop 106 is also coupled to the strobe input of the multiplexer 70 forcing its output 38 to logical 0. The enable input to the scaler 32 is therefore held logically low for blocking the transmission of any further waveform samples from bus 12 to bus 42. The signal stored in the latch 50 will therefore assume a 0 value and remain at this value until the decay enable conductor 22 again goes logically high indicating that the entire envelope generating sequence is to be repeated again.

Figure 11:
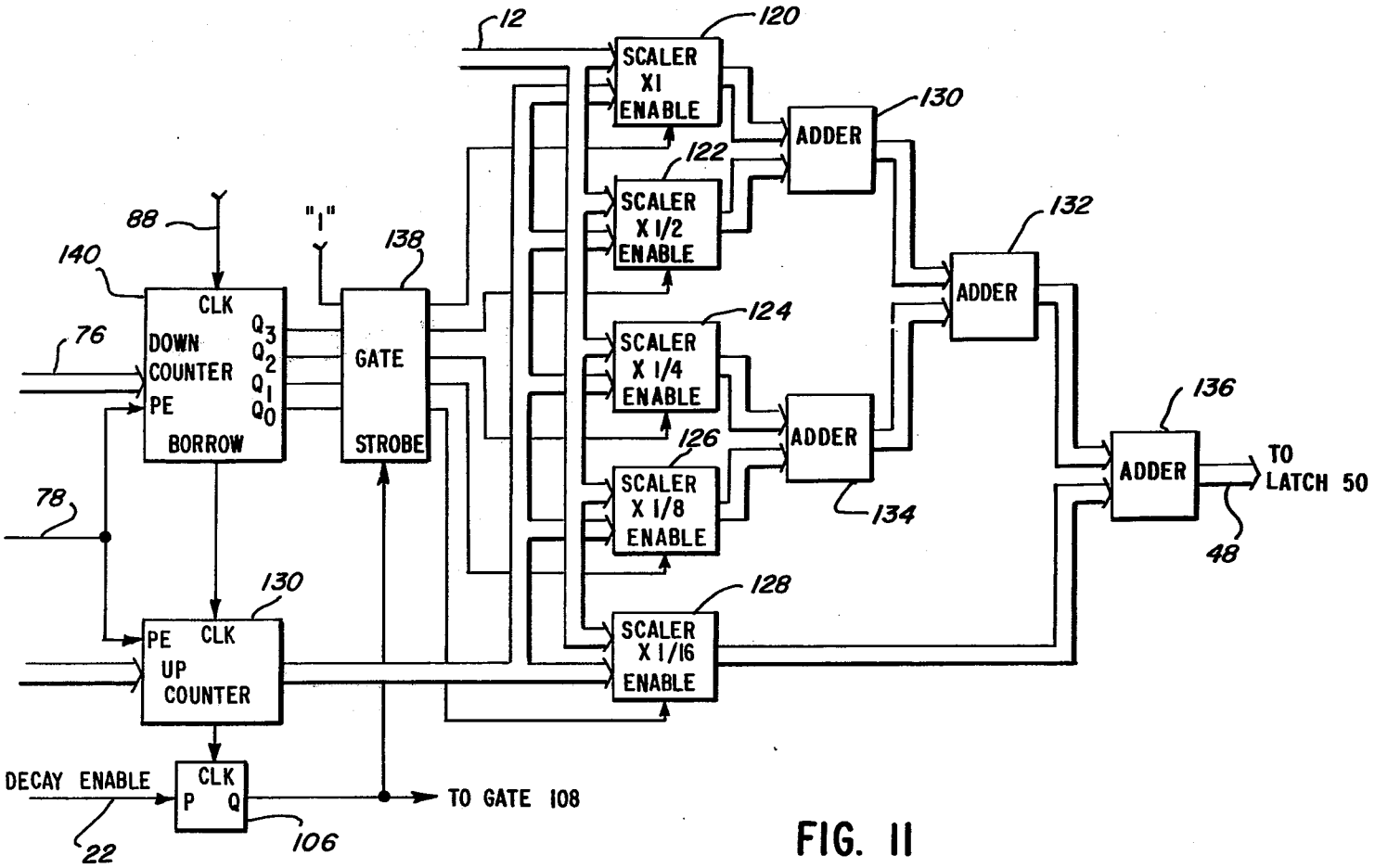
FIG. 11 illustrates an alternate embodiment of the envelope generator of the invention which utilizes parallel techniques to apply an envelope to a waveshape signal.

The multiplication time of the circuit shown in FIGS. 1 and 7 is proportional to the number of clock periods required to calculate each step amplitude, five clock periods in this example, since the product is generated in a serial manner by accumulatively summing a series of shifted amplitude expressions. FIG. 11 illustrates an embodiment of the invention wherein each group of shifted amplitude expressions is generated in a parallel manner so that the multiplication time is determined only by the propagation delay time through the circuit. While faster multiplication times are achieved by the circuit, such is realized at the expense of additional multiplication circuits.

Referring to FIG. 11, the illustrated parallel embodiment of the invention includes five scalers 120, 122, 124, 126 and 128 each having a data input connected to bus 12 for receiving waveform samples from the waveshape memory 10. The five scalers 120–128 are characterized by "wired shifts" such that each successive one of the scalers performs a right shift operation offset one bit from the previous scaler. Thus assuming a 0 value program input to the scalers, scaler 120 is wired for shifting input data 0 places to the right (multiplication by 1), scaler 122 is wired for shifting input data one place to the right (multiplication by $\frac{1}{2}$), scaler 124 is wired for shifting input data two places to the right (multiplication by $\frac{1}{4}$), scaler 126 is wired for shifting input data three places to the right (multiplication by $\frac{1}{8}$) and scaler 128 is wired for shifting data four places to the right (multiplication by 1/16). In addition, each of the scalers 120–128 receives a program input from the output of an up counter 130 which corresponds to the up counter 82 of FIG. 7. The outputs of scalers 120 and 122 are summed in an adder 130 and coupled to the first input of a second adder 132. The outputs of scalers 124 and 126 are summed in a further adder 134 and coupled therefrom to the second input of the adder 132. The output of scaler 128 is summed with the output of adder 132 in a final adder 136 and coupled therefrom by bus 48 to the output latch 50.

Each of the scalers 120–128 includes an enable input connected to a respective output of a five line gate 138. The gate 138 includes a first input hard wired to a logical 1 signal source and four additional inputs connected to the outputs $Q_3$ and $Q_0$ of a four stage down counter 140 which corresponds to the down counter 72 of FIG. 7. The down counter 140, which is preset to an initial gain code in response to a preset enable signal on conductor 78, includes a borrow output connected to the clock input of up counter 130. Finally, the carry output of the up counter 130 is connected to the clock input of flip-flop 106 whose Q output is used to strobe the gate 138.

Assume initially that both the down counter 140 and the up counter 130 are preset to initial gain codes of zero. In this condition, the program output of the up counter 130 is 0000 and only the first output of the gate 138 is logically high. As a result, only the scaler 120 is enabled, the scaler coupling the waveform sample from the bus 12 through adders 130, 132 and 136 to the output latch 50. In response to a clock pulse on conductor 88 the down counter 140 transitions to state 1111 thereby generating a borrow pulse clocking the up counter 130 to state 0001. All of the outputs of the gate 138 are now logically high enabling all of the scalers and the program code supplied to the scalers represents a shift of one place to the right. Assuming again a unity value waveform sample on bus 12, the output of scaler 120 therefore represents a signal amplitude of $\frac{1}{2}$, the output of scaler 122 a signal amplitude of $\frac{1}{4}$, the output of scaler 124 a signal amplitude of $\frac{1}{8}$, the output of scaler 126 the signal amplitude of 1/16 and the output of scaler 128 the signal amplitude of 1/32. The outputs of the scalers are coupled by the adders 130–136 to bus 48 in the form of a signal amplitude corresponding to $\frac{1}{2}+\frac{1}{4}+\frac{1}{8}+1/16+1/32$. In response to the next clock pulse on conductor 88, scaler 128 only is disabled whereby the sum produced on bus 48 corresponds to $\frac{1}{2}+174+\frac{1}{8}+1/16+0$. The foregoing process is repeated as the counter 140 is clocked by additional clock pulses on conductor 88 until the sixteen step staircase signal corresponding to segment A is produced. Thereafter, another borrow pulse is produced at the output of the down counter 140 clocking up counter 130 to state 0010. The sixteen step staircase signal forming segment B, whose step size is 1/32, is therefore formed on bus 48. When the up counter 130 overflows after the eleven segment signal has been produced its carry output will go logically high clocking flip-flop 106 and causing its Q output to switch high. The Q output of flip-flop 106 will strobe the gate 138 and thereby terminate operation of the circuit.

Figure 12:
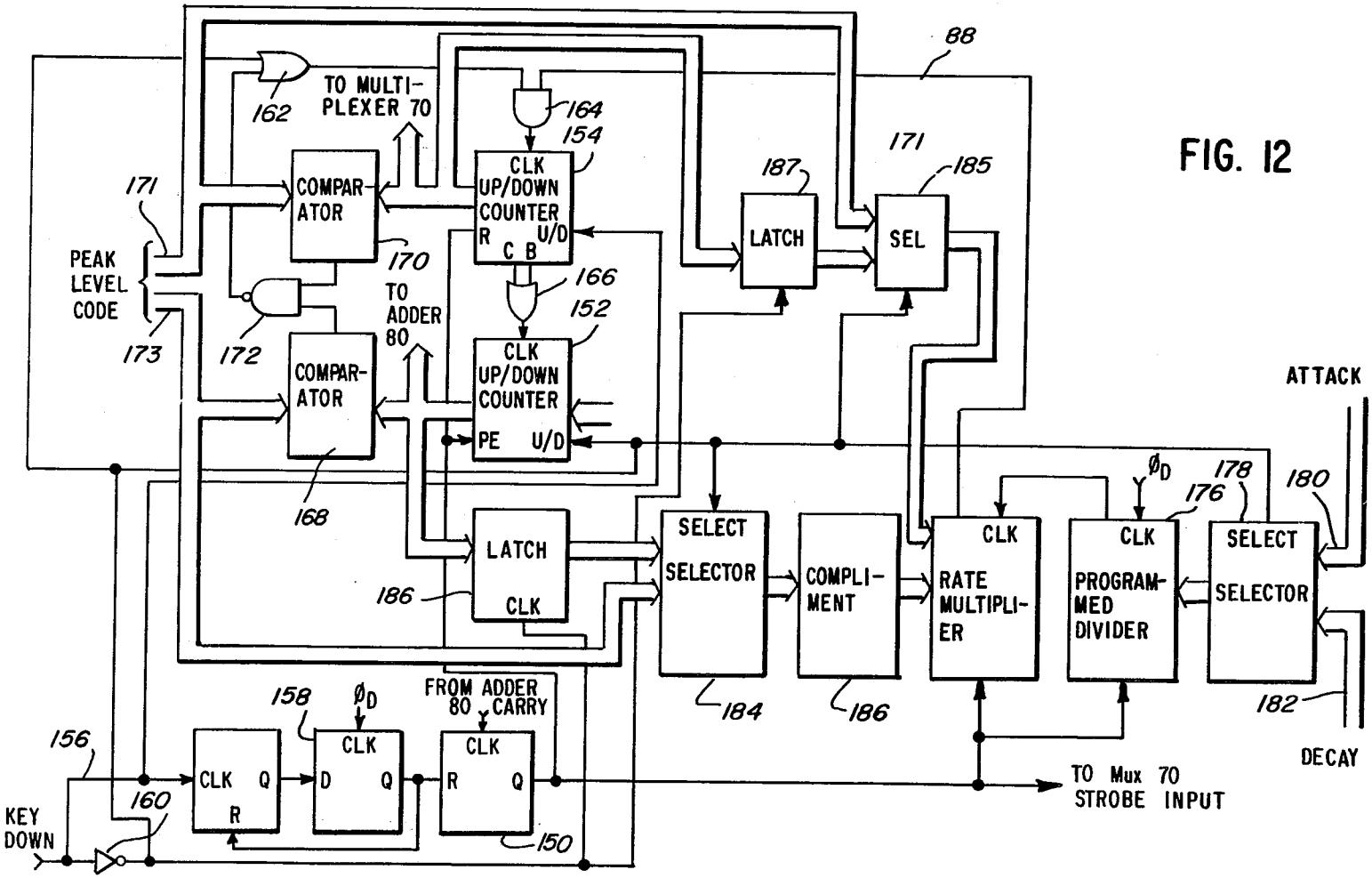
FIG. 12 is a block diagram showing a modification of the control circuit 34 of FIG. 1 for enabling the generation of an envelope signal having attack and decay portions.
Figure 13:
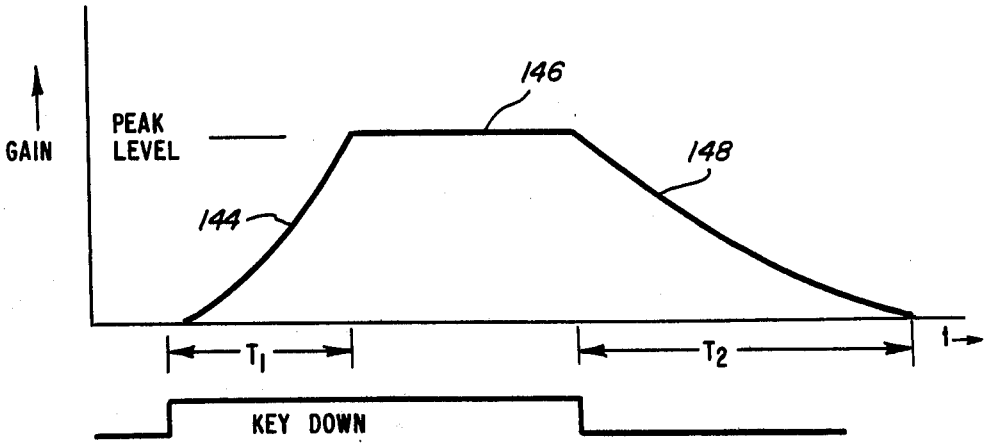
FIG. 13 is a graphical representation of an envelope having an attack portion, a sustain portion and a decay portion.

Another embodiment of the invention is shown in FIG. 12. This embodiment utilizes the principles of the present invention for imposing an envelope having both attack and decay portions on a constant level digitally generated signal in response to a key down signal. An envelope of this type is illustrated in FIG. 13 and will be seen to comprise an attack portion 144 initiated in response to a key down signal. The attack portion 144 is followed by a constant level sustain portion 146 and a decay portion 148 initiated in response to key release.

Referring to FIG. 12, the illustrated circuit is adapted to interface with the envelope generator of FIG. 1 by implementing the control circuit 34 in lieu of the control circuit embodiment of FIG. 7. Although not shown in FIG. 12, it is to be understood that the multiplexer 70, the up counter 74 and the adder 80 of FIG. 7 form part of the circuit of FIG. 12.

Referring now in detail to FIG. 12, at the beginning of an envelope generating cycle, the Q output of a flip-flop 150 is logically high presetting a first up/down counter 152 (corresponding to up counter 82 of FIG. 7 to a state corresponding to decimal 11 and resetting a second up/down counter 154 (corresponding to down counter 72 of FIG. 7) to a zero state. When a key of the musical instrument is depressed a logical 1 key down signal is produced on a conductor 156 causing a single pulse to be produced at the Q output of a flip-flop 158 for resetting the flip-flop 150 and thereby enabling the counters 152 and 154. Counter 152 is conditioned for operation in its down count mode by a logical 0 signal developed at the output of an inverter 160 while counter 154 is conditioned for operation in its up count mode by the logical 1 key down signal on conductor 156. An OR gate 162, whose output is logically high, enables an AND gate 164 for coupling clock pulses from conductor 88 to the clock input of counter 154. Counter 154 therefore begins counting up from state 0000 while counter 152 counts down from the preset value, decimal 11, in response to carry pulses produced by the counter 154 and coupled through an OR gate 166.

It will be appreciated that the enabling signals coupled by the multiplexer 70 to the scaler 32 in response to the up counter 74 and the counter 154 will be developed in a manner opposite of that previously described. That is, the initial sequence of five enabling signals used to calculate the amplitude of the first step of the attack portion 144 is 1–0–0–0–0. The sequence used to calculate the amplitude of the second step is 10001 while the sequence used to calculate the amplitude of the third step is 10010. The sequences used to calculate the next successive steps in each sixteen step staircase signal increases by a factor of 1 so that the staircase signal progressively increases in amplitude as represented by portion 144. In addition, counter 152 is providing a maximum output to the adder 80 so that the program codes provided on bus 36 are maximized for the initial sixteen steps. For each succeeding series of sixteen steps the count characterizing counter 152 is decremented by a factor of one with the resulting program codes developed on bus 36 likewise decreasing. As a result, the initial sixteen steps of the attack portion 144 are characterized by relatively small amplitudes and a relatively small step size. As the count of counter 152 is decremented for each succeeding sixteen step staircase signal, the step size increases by a factor of $\frac{1}{2}$ and the amplitudes of the steps will also correspondingly increase. As a result, a concavely shaped exponential attack envelope 144 as illustrated in FIG. 13 is produced.

In response to the outputs of counters 152 and 154 achieving a state equal to a selected peak level code developed on a pair of buses 171 and 173, the equality outputs of a pair of comparators 168 and 170 go logically high. The logically high equality signals developed by the comparators 168 and 170 cause the output of an AND gate 172 to go logically low preventing the AND gate 164 from coupling further clock pulses to counter 154 from conductor 88. Counters 152 and 154 remain in the states which produced the logically high equality signals, i.e. equivalent to the peak level code, as long as the logical 1 key down signal persists. This condition is illustrated by the constant level sustain portion 146 of the envelope shown in FIG. 13.

In response to the depressed key being released, the key down signal on conductor 156 goes logically low and the output of inverter 160 goes logically high. The high level signal at the output of inverter 160 causes the output of OR gate 162 to go logically high again enabling the AND gate 164 for coupling clock pulses to the counter 154. Counter 154, which has been placed in its down count mode by the logical 0 signal on conductor 156, begins counting down from the peak level code and counter 152, which has been placed in its up count mode by the logical 1 signal developed at the output of inverter 160, begins counting up in response to borrow pulses coupled thereto through OR gate 166. It will be appreciated that the circuit is now operating in a manner precisely equivalent to the circuit of FIG. 7 whereby the decay portion 148 of the envelope is generated. Eventually, the adder 80 will overflow generating a carry pulse causing the Q output of flip-flop 150 to go high for again resetting counter 154 and presetting counter 152. The strobe input to the multiplexer 70 will also go high at this time holding the output signal waveform at a zero level.

As in the case of the FIG. 7 embodiment, the clock signal on conductor 88 in FIG. 12 is developed at the output of a rate multiplier 174. The clock input of the rate multiplier 174 is supplied from the output of a programmable divider 176 which is clocked in response to clock signal $\phi_d$. The divide ratio characterizing the programmable divider 176 is determined by the output of a selector circuit 178 whose control input is connected to the output of inverter 160. In response to the depression of a keyboard key, the output of inverter 160 goes logically low causing the selector 178 to couple a first divide ratio from an attack bus 180 to the divider 176. The binary code developed on the attack bus 180 determines the attack time $T_1$ by forcing the clock signal on conductor 88 to assume a suitable repetition rate. In response to the key being released, the output of inverter 160 goes logically high causing the selector 178 to couple a second binary code from a decay bus 182 for setting the divide ratio of the divider 176. The binary code developed on the decay bus 182 determines the decay time $T_2$ by forcing the clock signal on conductor 88 to assume a corresponding value.

Figure 14:
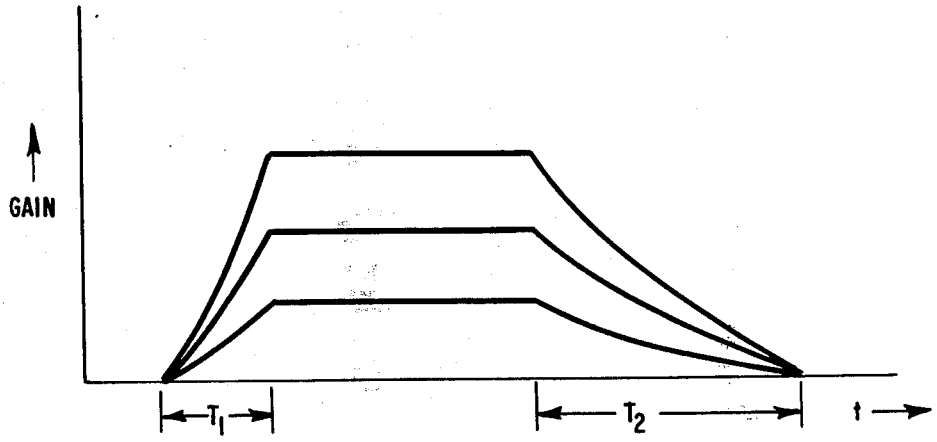
FIG. 14 graphically illustrates the compensation effect of attack and decay times realized by the circuit of FIG. 12 for different gain settings.

The output of the inverter 160 is also coupled to the control inputs of selector circuits 184 and 185. In response to a logical 0 signal at the output of inverter 160, corresponding to a logical 1 key down signal on conductor 156, the selector 184 couples the peak level code from bus 173 through a complementor 186 to the four most significant program inputs of the rate multiplier 174. At the same time, the selector 185 couples the peak level code from bus 171 directly to the four least significant program inputs of the rate multiplier 174. This serves to compensate the attack time $T_1$ for different peak level codes. That is, the time $T_1$ is maintained substantially constant regardless of the selected peak level code as illustrated in FIG. 14. In response to the depressed key being released, the output of inverter 160 goes logically high causing the selectors 184 and 185 to couple the outputs of a pair of latches 186 and 187 to the program inputs of the rate multiplier 174, the output of latch 186 being coupled through the complementor 186. The latches 186 and 187 are simultaneously clocked by the output of inverter 160 for storing the states of counters 152 and 154 respectively at the time of key release. As a result, the decay time $T_2$ will remain substantially equal for different peak level codes and will also remain substantially equal even if the depressed key is released before the attack portion 144 is completed.

The attack signal produced by the circuit of FIG. 12, see portion 144 of the waveform of FIG. 13, has a concave exponential inflection. It is often desired to produce a smoother attack signal which is either linear or has a convex exponential inflection. The circuit of FIG. 15 illustrates a modified embodiment of the circuit of FIG. 12, which modified embodiment is adapted for selectively generating either a concave exponential or a linear attack signal.

Figure 15:
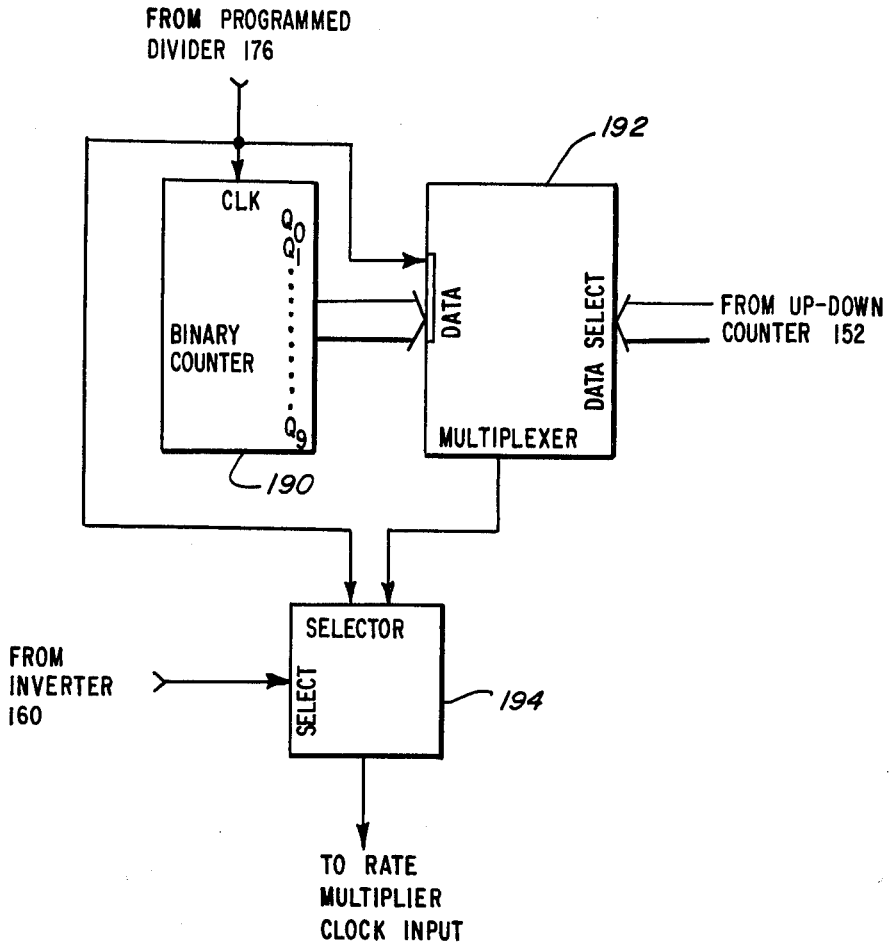
FIG. 15 is a block diagram illustrating another modification of the control circuit 34 adapted for producing a linear attack envelope.
Figure 16:
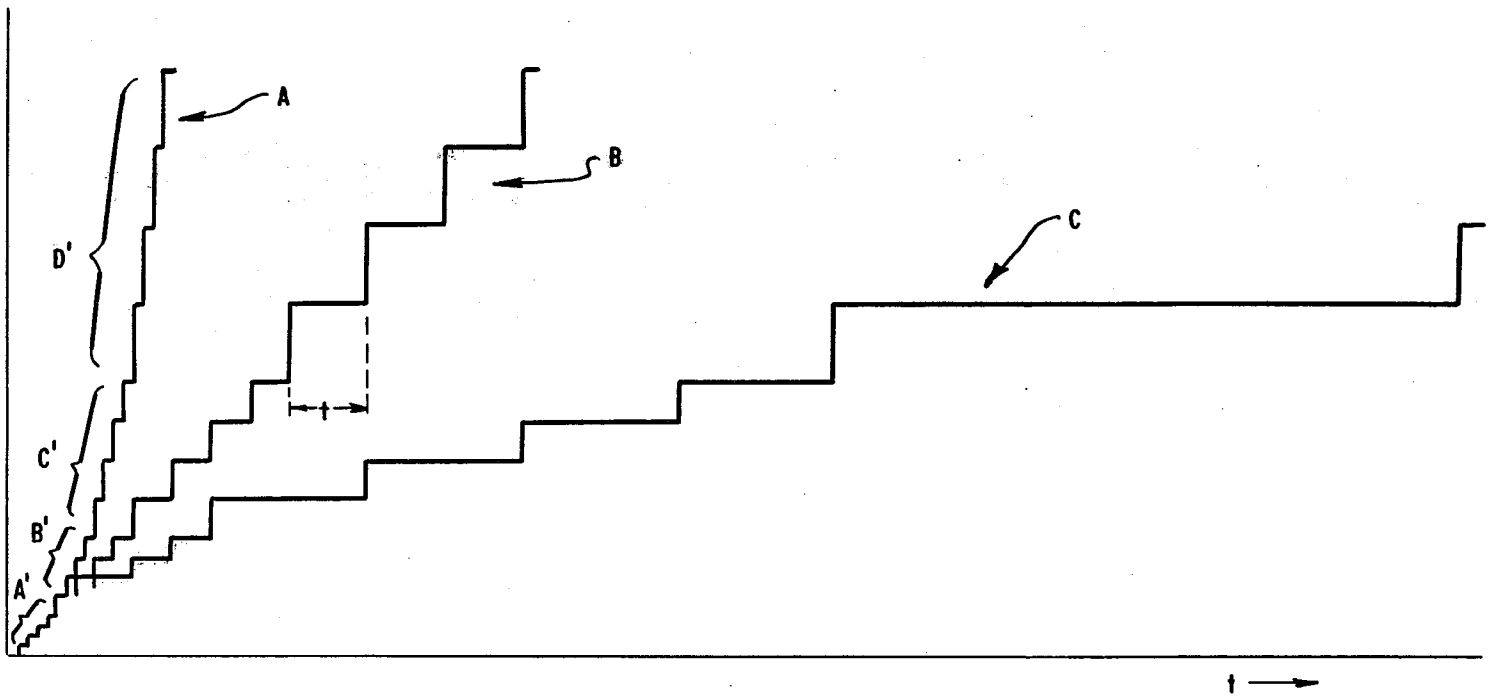
FIG. 16 graphically depicts the techniques utilized by the envelope generator of the invention to generate concave exponential, linear and convex exponential envelopes.

Before discussing the detailed implementation of the modified embodiment shown in FIG. 15, it may be helpful to initially examine the theory upon which its operation is based. Referring to FIG. 16, a first staircase signal A is illustrated which simulates a concave exponential attack signal. This general type of signal is produced by the circuit of FIG. 12 when operating in the attack mode. It will be observed that the step size of the initial or first segment A′, four steps being shown instead of sixteen for ease of illustration, is relatively small. The step size of the next four step segment B′ is double that of segment A′. The step size of the next segment C′ is double that of the step size of B′, and so no. Now, while the step size doubles with each succeeding segment, the step duration t of each step remains constant and is determined by the clock frequency on conductor 88 regardless of the segment in which a particular step is located. The combined effect of doubling the step size with succeeding segments while maintaining the step duration t constant results in the concave exponential inflection characterizing the signal. Curve B of FIG. 16 illustrates how the modified embodiment of FIG. 15 achieves a linear attack signal. In curve B, it will be noted that the step size of each succeeding segment doubles as in the case of curve A. However, at the same time, the step duration t also doubles. Thus, while the step size of segment D' is eight times larger than the step size of segment A', the step duration characterizing segment D' is also eight times larger than the step duration characterizing said A'. The result of the foregoing is that curve B exhibits a linear rather than a concave exponential shape.

Referring now to FIG. 15, the output of the programmable divider 176 of FIG. 12 is coupled to the clock input of a 10 stage binary counter 190 and to a first data input of an eleven line to one line multiplexer 192. The outputs $Q_0$–$Q_9$ of the counter 190 are respectively connected to the next ten data inputs of the multiplexer 192. The data select input of the multiplexer 192 is supplied from the output of counter 152 of FIG. 12 and the output of the multiplexer is coupled to one input of a selector circuit 194. The second input to the selector 194 is derived from the output of the programmable divider 176 and the control input from the output of inverter 160. Finally, the output of selector 194 is coupled to the clock input of the rate multiplier 174 which generates the clock signal on conductor 88.

When the circuit of FIG. 12 is in the attack mode of operation, the output of inverter 160 is logically low causing the selector 194 to couple the output of multiplexer 192 to the clock input of rate multiplier 174. The initial state of counter 152 corresponds to decimal 11 which causes the multiplexer 192 to couple the signal present at its first data input, i.e. the output of divider 176, to the input of selector 194. Consequently, during the generation of the first segment of the attack signal, the clock signal supplied to conductor 88 has a relatively high frequency such that the resulting staircase signal is characterized by a correspondingly small step duration. For the next segment of the attack signal, the state of counter 152 corresponds to decimal 10 whereby the $Q_0$ output of counter 190 is coupled by the multiplexer 192 to the selector 194. Since the frequency of the signal appearing at the $Q_0$ output of counter 190 is $\frac{1}{2}$ the frequency developed at the output of the programmable divider 176, the clock signal produced on conductor 88 will be $\frac{1}{2}$ its previous value. As a result, the step duration characterizing the second segment will be twice as large as the step duration of the previous segment. The third segment is produced in a corresponding manner. That is, the state of counter 152 corresponds to decimal 9 whereby the $Q_1$ output of counter 190 is coupled by multiplexer 192 to the selector 194. Since the signal appearing at the $Q_1$ output of the counter is $\frac{1}{2}$ the frequency of the signal appearing at the counter's $Q_0$ output, the step duration t of the segment is increased by a factor of two as compared to the previous segment. To summarize, the frequency of the signal coupled by the multiplexer 192 to the selector 194 will be of the form $f/2^n$ were f represents the frequency of the signal developed at the output of the divider 176 and n is an integer taking on values from 0 to 10 with succeeding segments.

In response to the initiation of the decay portion 148 of the envelope, the output of inverter 160 goes logically high causing the selector 195 to couple the output of divider 176 directly to the clock input of rate multiplier 174. The circuit of FIG. 12 will therefore produce a concave exponential decay as previously discussed.

The circuit of FIG. 15 may also be slightly modified to produce a convex exponential attack signal as illustrated by curve C of FIG. 16. It will be observed that the step duration t of curve C increases by a factor of $2^{2n}$ instead of by a factor of $2^n$ as in the linear case. Thus, the step duration of curve C for succeeding segments increases by a factor of 4 instead of 2 as in the linear case. The circuit of FIG. 15 may therefore be conveniently modified for producing a convex exponential attack signal by, for example, using a 20 stage counter in place of counter 190 and coupling every other output of the counter to the data inputs of the multiplexer 192.

Figure 17:
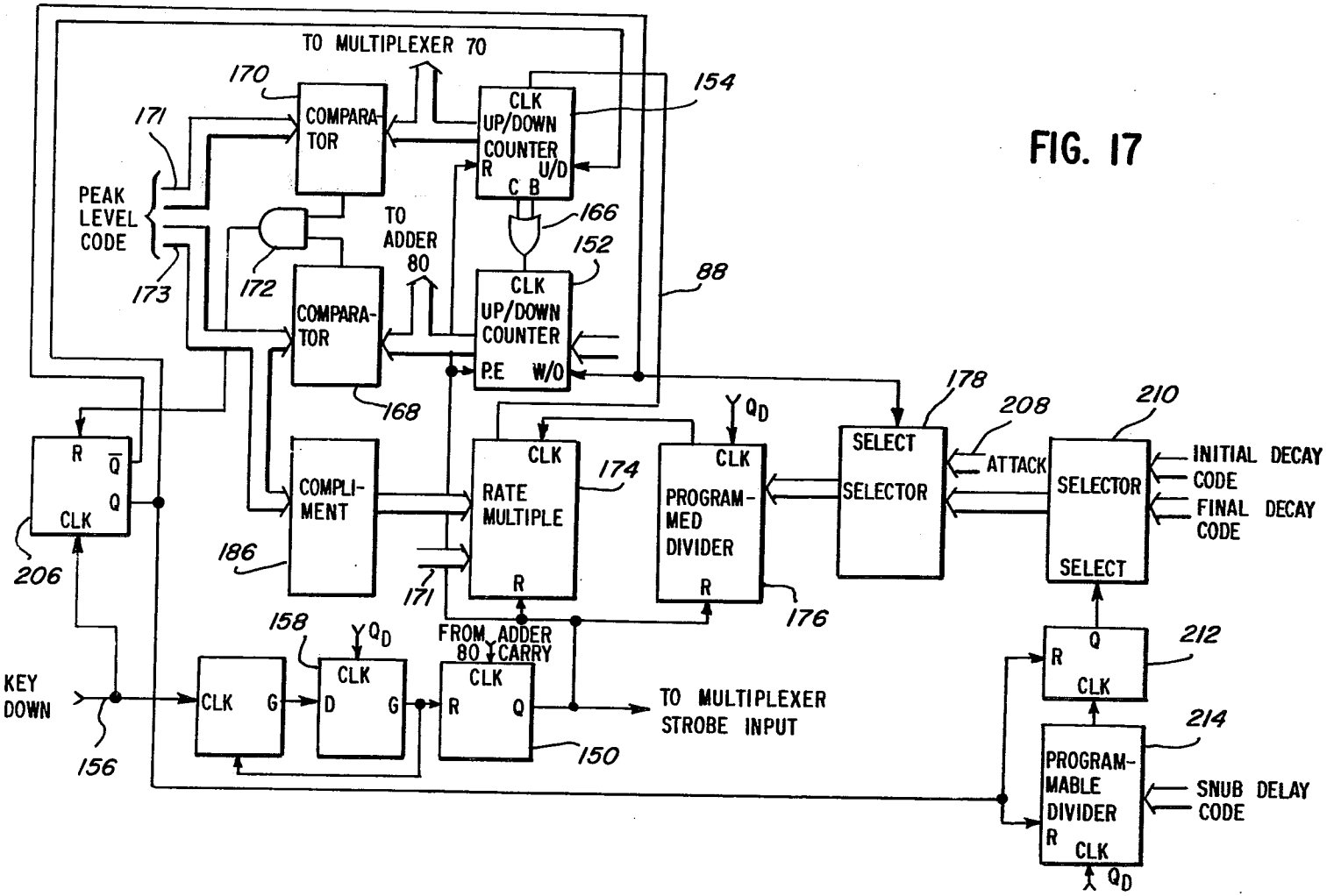
FIG. 17 is a further modification of the control circuit 34 adapted for achieving a percussive envelope.
Figure 18:
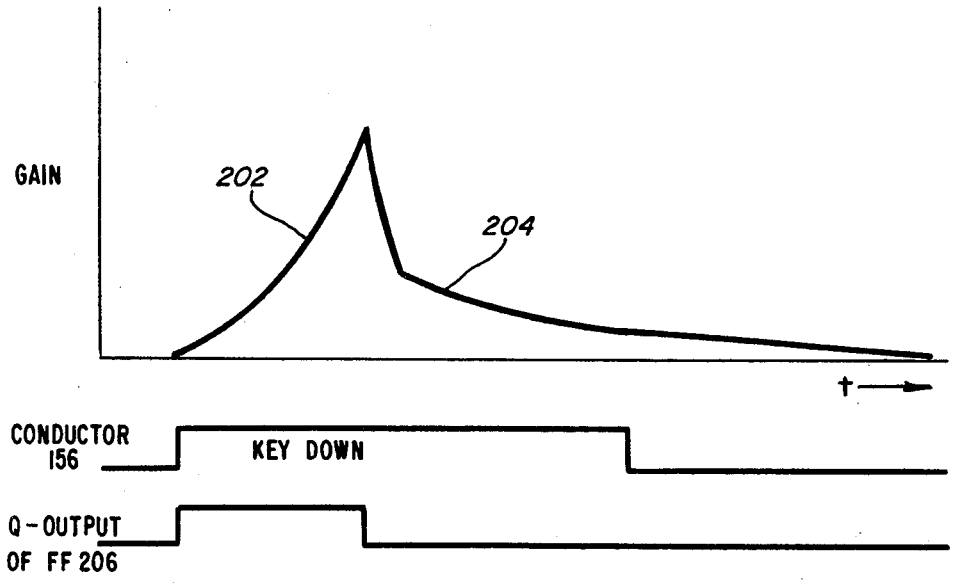
FIG. 18 is a percussive envelope having an attack portion immediately followed by a decay portion.

FIG. 17 illustrates another embodiment of the envelope generator of the invention which is adapted for producing a percussive envelope, i.e. an envelope in which the decay is started immediately after the attack reaches a peak level. An envelope of this general type is illustrated in FIG. 18 and will be seen to comprise an exponential attack portion 202 followed immediately by a two part decay portion 204. Employing a two part decay as exemplified by portion 204 which is characterized by a relatively rapid initial decay rate and a relatively slow final decay rate enhances the percussive effect realized by the envelope.

The circuit of FIG. 17 is largely similar to the circuit shown in FIG. 12 except that the key down signal developed on conductor 156 is used to clock a flip-flop 206, the $\overline{Q}$ output of flip-flop 206 being connected for controlling the mode of operation of counter 154 and the Q output of flip-flop 206 being connected for controlling the mode of operation of counter 152 as well as that of selector circuit 178. Also, OR gate 162, latch 186 and selector circuit 184 of FIG. 12 are not included in the embodiment of FIG. 17 since the function of these components related only to the generation of the constant level sustain portion 146 of the envelope produced by the circuit of FIG. 12. Upon being clocked by a key down signal, the flip-flop 206 places counter 152 in its down count mode of operation, counter 154 in its up count mode of operation, and causes selector circuit 178 to couple an attack code developed on a bus 208 for setting the divide ratio of programmable divider 176. With this set of conditions, the circuit of FIG. 17 is operative for producing the attack portion 202 which is characterized by an attack rate determined by the attack code supplied on bus 208.

In response to the state of counters 152 and 154 coinciding with the peak level codes developed on buses 171 and 173, the output of AND gate 172 goes logically high resetting flip-flop 206. As a consequence, the mode of operation of counters 152 and 154 are reversed and the selector circuit 178 is operated for coupling the output of a second selector circuit 210 for setting the divide ratio characterizing programmable divider 176. Also, a snub delay circuit, comprising a flip-flop 212 and a programmable divider 214 is taken out of reset for controlling the selector 210. The Q output of the snub delay flip-flop 212 is initially at a logically low level causing the selector 210 to couple an initial decay code for setting the divide ratio of programmable divider 176. This results in the generation of the first part of the decay curve 204 which decays at a relatively rapid rate. Afrer a predetermined time interval established by a snub delay code which is used to set the divide ratio of the programmable divider 214, flip-flop 212 is clocked whereby its Q output goes logically high operating the selector 210 for coupling a final decay code for setting the divide ratio of programmable divider 176. The final decay code causes the clock signal on conductor 88 to be modified for producing the second part of the decay curve 204 which decays at a relatively slow rate.

Figure 19:
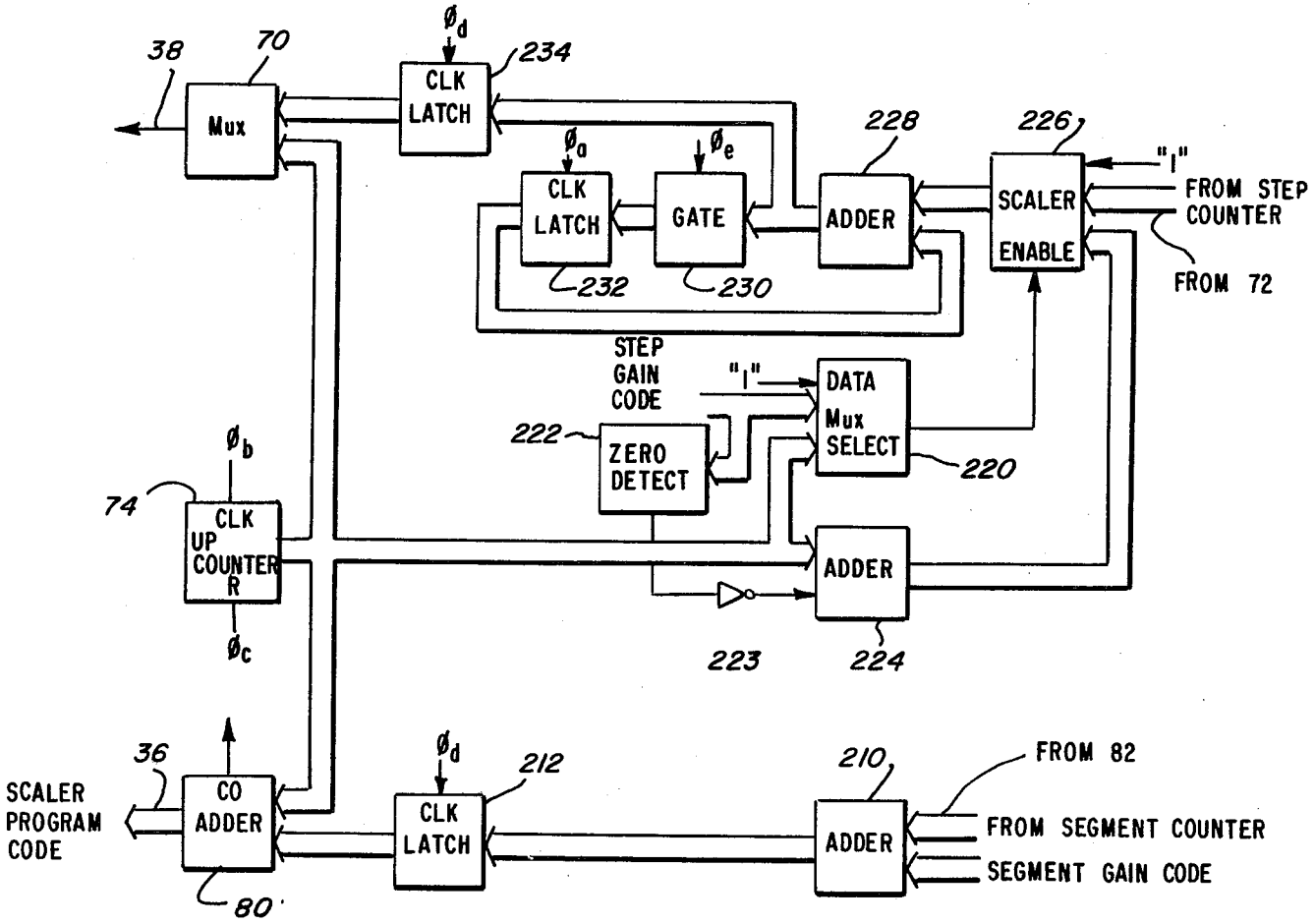
FIG. 19 is a block diagram illustrating a gain adjustment circuit useful in association with the envelope generator of the invention.

FIG. 19 illustrates a modification to the control circuit 34 for enabling the gain of the envelope signal to be adjusted either prior to the production of the envelope or at some time while the envelope is being produced. While the gain adjustment circuit shown in FIG. 19 will be explained as modifying the operation of the control circuit of FIG. 7, it is to be understood that a similar modification may be made to the control circuits of any of the other embodiments of the envelope generator discussed herein.

With reference to FIG. 19, it will be observed that the illustrated gain adjustment circuit forms an interface between the output circuits, including multiplexer 70 and adder 80, of the control circuit 34 of FIG. 7 and the input circuits, including the counters 72 and 82, of the control circuit 34 of FIG. 7. In particular, the output of counter 82 together with a segment gain code are coupled to the inputs of an adder 210, the output of adder 210 being supplied to the input of a latch 212. The output of the latch 212, which is clocked by clock signal $\phi_d$, is applied to one input of the adder 80, the other input to the adder 80 being supplied from the output of up counter 74 as previously described. It will be recalled that the program code for the scaler 32 is developed on the output bus 36 of the adder 80.

Course adjustment of the gain characterizing the envelope is accomplished by suitably selecting the segment gain code coupled to one input of the adder 210. A maximum value of gain is achieved by setting the segment gain code to 0000. In this case, the output of the up counter 82 is coupled in unmodified form through the latch 212 to the input of the adder 80. The adder 80 therefore develops program codes on output bus 36 exactly as described with reference to FIG. 7 so that a maximum envelope gain is realized. If it is desired to reduce the gain of the envelope by a factor, for example, of $\frac{1}{2}$, a segment gain code of 0001 is coupled to the input of adder 210. This segment gain code increases the count coupled to the input of adder 80 by a factor of unity which serves to offset the program codes developed on bus 36 a corresponding amount. As a consequence, each output of the scaler 32 is shifted one additional place to the right whereby the magnitude of the signals developed at the output of latch 50 are all reduced by $\frac{1}{2}$ from the values they would otherwise have (i.e. with a segment gain code of 0000), the net result being a reduction in the overall gain of the envelope of $\frac{1}{2}$. In a similar manner, the envelope gain can be reduced to $\frac{1}{4}$ of its maximum value by setting the segment gain code to 0010 in which case the program codes developed on bus 36 are offset or increased by a factor of two. The gain of the envelope is reduced to $\frac{1}{8}$ its maximum value by setting the segment gain code to 0011, to 1/16 of its maximum value by setting the segment gain code to 0100, and so on.

Fine adjustment of the envelope gain are accomplished by suitably modifying the enabling signals developed at the output of multiplexer 70 and coupled by line 38 to the scaler 32. In this regard, fine adjustments are intended to mean adjustments of gain between the limits of course adjustments described above. Referring again to FIG. 19, a four bit step gain code, representing the desired amount of fine adjustment of the envelope gain, is coupled to the data input of a five line to one line multiplexer 220, the most significant data input of the multiplexer 220 being hard wired to a logical 1 signal source. The four bit step gain code is also coupled to the input of a zero detect circuit 222 whose output is connected by an inverter 223 to one input of an adder 224. The output of counter 74 is connected to the select input of multiplexer 220 and also to the other input of adder 224. The output of adder 224 is connected to the program inputs of a right shift scaler 226, the scaler 226 being enabled in response to the output of multiplexer 220. The most significant data input of the scaler 226 is hard wired to a logical 1 signal source with the next succeeding four data inputs being derived from the output of the down counter 72. The output of the scaler 226 is connected to a summation circuit, including an adder 228, a gate 230 and a pair of latches 232 and 234, configured and operable exactly the same as the output summation circuit of FIG. 1. Finally, the five bit output of latch 234 is connected to the five data inputs of the multiplexer 70 in lieu of the connections shown in FIG. 7.

The function of the fine adjust circuit described above is to modify the enabling signals which would otherwise be coupled by the multiplexer 70 to the scaler 32. The effect of so modifying the enabling signals is to fine adjust the envelope gain, according to the selected step gain code, within the limits of adjustment effected by the segment gain code. For example, assume initially that maximum envelope gain is desired. In this case, the segment gain code is set to 0000 as previously described. Also, the step gain code is set to 0000. The zero value step gain code will repetitively cause a 5 bit sequence of enabling signals to be developed at the output of multiplexer 220 of the form 1—0—0—0—0. The scaler 226 is therefore enabled only during the initial clock pulse of each five clock pulse system cycle. At the same time, a 0 logic signal is coupled from the inverter 223 to the input of adder 224. Since the scaler programming signal developed at the output of adder 224 is therefore logical 0 during the production of the initial enabling signal of each 5-bit sequence, the logic signals supplied to the data inputs of the scaler 226 will be coupled in unmodified form to the output of the scaler in response to the initial enabling signal. And, since the scaler 226 is disabled during the next four clock periods, the logic signal accumulated in latch 234 at the end of each system cycle will correspond exactly to the logic signal supplied to the data inputs of the scaler 226 correspond exactly to the logic signals coupled to multiplexer 70 in the control circuit of FIG. 7 when the initial gain code has preset counter 72 to 0000 for maximizing the envelope gain, the enabling signals developed on the output 38 of the multiplexer 70 in FIG. 19 will also result in maximum envelope gain.

Assume now that it is desired to reduce the gain of the envelope from its maximum value by a factor of, for example, $\frac{3}{4}$. To effect this gain adjustment, the segment gain code remains set at 0000 but the step gain code is increased to 1000. As a result, the sequence of enabling signals repetitively developed at the output of multiplexer 220 will assume the form 1—1—0—0—0 for enabling the scaler 226 during the first two clock pulses of each five clock pulse system cycle. The output of inverter 223 will consequently go logically high in response to the non-zero value step gain code whereby the adder 224 will develop scaler program codes of 0001 and 0010 respectively during the first two clock periods of each system cycle. Thus, the logic signals coupled to the data inputs of the scaler 226 will be shifted one place to the right in response to the first enabling signal from multiplexer 220 and will be shifted two places to the right in response to the second enabling signal from the multiplexer 220. The sum of the two shifted logic signals are stored in latch 234 in response to each $\phi_d$ pulse and coupled therefrom to the data inputs of multiplexer 70. As an example, it will be recalled that with a zero value scaler program code developed on output bus 36 of adder 80, the initial sequence of enabling signals developed on output 38 of multiplexer 70, i.e. 1−0−0−0−0, normally results in a signal having an amplitude of unity being stored in latch 50. However, with the step gain code of the gain adjustment circuit of FIG. 19 set to 1000, the foregoing sequence of enabling signals is modified at the output of latch 234 to the form 0−1−1−0−0. This sequence of enabling signals, the scaler program code developed on bus 36 of the adder 80 still having a zero value, will cause the signal stored in the output latch 50 to represent an amplitude of 0.75 $(0+\frac{1}{2}+\frac{1}{4}+0+0)$ whereby the initial gain of the envelope is reduced from unity to $\frac{3}{4}$. Subsequent sequences of enabling signals are similarly coupled to the scaler 32 in modified form so that each signal stored in the output latch 50 is reduced in amplitude by a factor of approximately $\frac{3}{4}$ from its normal value. As a result, the staircase envelope signal developed at the output of latch 50 is reduced by a factor of approximately $\frac{3}{4}$ from its maximum gain.

It will be appreciated that other gain adjustment factors between 1 and $\frac{1}{2}$ will be achieved by employing different step gain codes. If a gain having a value between $\frac{1}{2}$ and $\frac{1}{4}$ is desired, the segment gain code is increased to 0001 and the step gain code is set to a value for achieving the exact gain desired within this range. Similarly, a value of gain between 174 and $\frac{1}{8}$ may be achieved by setting the segment gain code to 0010 and suitably setting the step gain code for achieving the desired gain within this range, and so on.

The gain adjustment circuit of FIG. 19 operates to produce an abrupt change in the gain of the envelope when either the step or segment gain codes are changed. This results in a musically undesirable audio click occasioned by the substantially instantaneous change in amplitude of the audio signal. The circuit of FIG. 20 overcomes this problem by providing a smooth transition from a previous step or segment gain code to a newly selected step or segment gain code.

Figure 20:
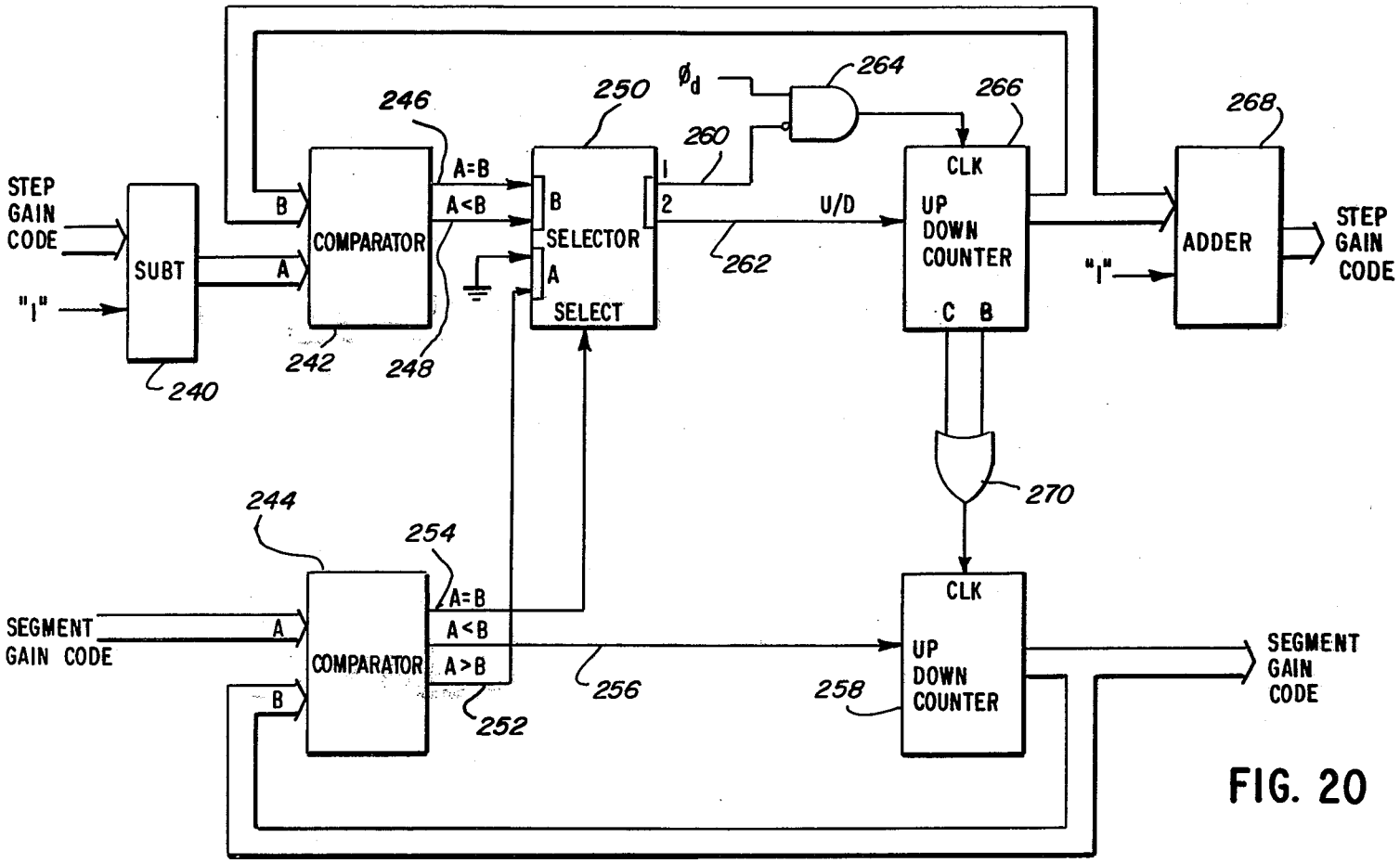
FIG. 20 is a block diagram showing an interface circuit enabling the production of smooth gain adjustment transitions by the circuit of FIG. 19.

Referring in detail to FIG. 20, the step gain code selected by a player on the control panel of the instrument is coupled to a binary subtractor 240 which couples the step gain code reduced by a factor of unity to the A input of a first comparator 242. The segment gain code is directly coupled from the control panel to the A input of a second comparator 244. The A=B and A<B outputs 246 and 248 of comparator 242 are connected to first and second B inputs of a selector circuit 250 the first and second A inputs of selector circuit 250 being derived from a logical 0 signal source and the A>B output 252 of comparator 244 respectively. The A=B output 254 of comparator 244 is connected to the select input of selector circuit 250 and the A<B output 256 of comparator 244 is connected to the up/down count control input of a binary counter 258. Counter 258 is placed in its up count mode of operation in response to a logical 0 control signal and placed in its down count mode of operation in response to a logical 1 control signal. The output of counter 258, which represents the segment gain code supplied to the adder 210 of FIG. 19, is fed back to the B input of comparator 244.

A logical 0 signal on the A=B output 254 of comparator 244 causes selector circuit 250 to couple its first and second A inputs to a pair of output lines 260 and 262 respectively. On the other hand, a logical 1 signal on the A=B output 254 of comparator 244 causes selector circuit 250 to couple its first and second B inputs to output lines 260 and 262 respectively. Output line 260 is connected to the inverting input of an AND gate 264 whose other input is supplied with clock signal $B_d$. The output of AND gate 264 is connected to the clock input of a second up/down binary counter 266 whose output is fed back to the B input of comparator 242 and also coupled to one input of a binary adder 268. Adder 268, which operates to increase the output count of counter 266 by a factor of unity, develops the step gain code coupled to the input of multiplexer 220 of FIG. 19. Output line 262 of selector circuit 250 is employed to control the mode of operation of counter 266, a logical 0 signal on line 262 placing the counter in its up count mode of operation and a logical 1 signal on line 262 placing the counter in its down count mode of operation. Finally, the carry and borrow outputs of the counter 266 are coupled by an OR gate 270 to the clock input of the counter 258.

The effect of the circuit of FIG. 20 is to prevent the occurrence of an instantaneous change in the gain of the envelope by sequentially stepping a previous gain setting to a newly selected value at a rate of clock signal $\phi_d$. For example, assume that the step gain code had originally been set to 1000 and the segment gain code to 0000. As discussed previously, these gain segments will result in the envelope being reduced from its maximum value by a factor of $\frac{3}{4}$. Now, at some time during the generation of the envelope signal, assume that the step gain code is increased to 1010 and that the segment gain code is increased to 0001 for further reducing the gain of the envelope. Due to the equalizing effect of the comparators 242 and 244, just prior to the selection of the new step and segment gain codes the A and B inputs of comparator 242 are both 0111 while the A and B inputs of comparator 244 are both 0000. In response to the new gain code settings, the A input of comparator 242 is increased to 1001 whereby both outputs 246 and 248 of the comparator go to logical 0. Also, since the segment gain code has been increased to 0001, outputs 254 and 256 are logical 0 while output 252 is logical 1. As a consequence, a logical 0 signal is coupled to the select input of selector circuit 244 which, in response thereto, develops a logical 0 signal on output 260 and a logical 1 signal on output 262. The logical 0 signal on output line 260 enables gate 264 for coupling clock pulses to counter 266 which has been placed in its down count mode of operation by the logical 1 signal on output line 262. Counter 266 will therefore begin counting down from state 0111 for presenting an incrementally transitioning step gain code to the input of multiplexer 220 of FIG. 19.

At the same time, the logical 0 signal on output 256 of comparator 244 has placed counter 258 in its up count mode of operation. Counter 266, which is in its down count mode of operation, produces a borrow pulse in response to transitioning from state 0000 to state 1111, the borrow pulse being coupled through OR gate 270 to the clock input of counter 258 for incrementing the state of the counter to 0001. Since the A & B inputs of comparator 244 are now equal the A=B output 254 of the comparator goes logically high and its other two inputs go logically low. The selector circuit 250 therefore couples its first and second B inputs to output lines 260 and 262 which remain at logical 0 and logical 1 respectively. Counter 266 therefore continues counting down until state 1001 has been achieved wherein the A and B inputs of comparator 242 have been equalized. At this time, the A=B output 246 of comparator 242 goes logically high disabling gate 264 preventing the further coupling of clock pulses to the counter 266. At this point, the output of adder 268 corresponds to the newly selected step gain code and the output of counter 258 corresponds to the newly selected segment gain code. It will be appreciated that these gain codes have been derived in an incremental manner preventing an abrupt change in the envelope gain due to the selection of the new gain codes by the player of the instrument.

What has thus been shown is an improved envelope generator for an electronic musical instrument which implements a technique of sequential multiplication requiring a minimum number of calculations. The step size of the output staircase envelope signal is proportional to the output signal level so that the step noise is maintained at a constant level. Also, initial gains and peak levels can be varied to control volume and attack and decay times are completely programmable. Two part decays independent of peak levels may be realized and three different types of curves-linear, concave exponential and convex exponential may be generated. Finally, the envelope signals are generated by suitably operating a series of counters such that no memory devices are required.

While particular embodiments of the present invention have been shown and described, it will be obvious to those skilled in the art that various changes and modifications may be made without departing from the invention in its broader aspects. The aim of the appended claims, therefore, is to cover all such changes and modifications as fall within the spirit and scope of the invention.

What is claimed is:

1. In an electronic musical instrument of the type having means developing a plurality of series of successive binary waveform samples representing a musical waveform signal, apparatus for imposing an envelope on said plurality of series of waveform samples comprising:

scaling means operable for developing a plurality of different scaled representations of each of said binary waveform samples;

control means operating said scaling means for developing a group of scaled representations of each of said binary waveform samples, the sum of each of said groups representing the product of the associated binary waveform sample and a multiplication factor, said multiplication factor changing by a predetermined amount during each of said series of binary waveform samples with the predetermined amounts characterizing consecutive ones of said series differing by a multiple of two; and output means responsive to said scaling means for successively summing the scaled representations forming each of said groups for developing an output staircase signal comprising an amplitude modulated representation of said binary waveform samples.

2. Apparatus according to claim 1 wherein said control means comprises means operating said scaling means such that the sum of the scaled representations of each of said groups is less than the sum of a preceding one of said groups whereby, said output staircase signal comprises a decaying amplitude modulated representation of said plurality of series of binary samples.

3. Apparatus according to claim 2 wherein said control means includes timing means causing a predetermined number of each of said groups of scaled representations to be successively developed whereby, said decaying amplitude modulated representation assumes an exponential inflection.

4. Apparatus according to claim 1 wherein said control means comprises means operating said scaling means such that the sum of the scaled representations of each of said groups is greater than the sum of a preceding one of said groups whereby, said output staircase signal comprises an increasing amplitude modulated representation of said plurality of series of binary samples.

5. Apparatus according to claim 4 wherein said control means includes first timing means causing a predetermined number of each of said groups of scaled representations to be successively developed whereby, said increasing amplitude modulated representation assumes a concave exponential inflection.

6. Apparatus according to claim 4 wherein said control means includes second timing means for causing a number of each of said groups of scaled representations to be successively developed, said number increasing by a factor equivalent to said multiple of two each time said predetermined amount is changed whereby, said increasing amplitude modulated representation assumes a linear shape.

7. Apparatus according to claim 4 wherein said control means includes third timing means for causing a number of each of said groups of scaled representations to be successively developed, said number increasing by a factor equivalent to twice said multiple of two each time said predetermined amount is changed whereby, said increasing amplitude modulated representation assumes a convex inflection.

8. Apparatus according to claim 1 wherein said control means comprises means operated for sequentially developing the scaled representations of each of said groups.

9. Apparatus according to claim 1 wherein said control means comprises means operated for simultaneously developing the scaled representations of each of said groups.

10. Apparatus according to claim 2 including gain control means cooperating with said control means for selectively setting the sum of the scaled representations of the first developed of said groups in accordance with a desired initial gain.

11. Apparatus according to claim 10 including compensation means cooperating with said control means for causing said staircase signal to decay in a predetermined time interval regardless of the selected value of said initial gain.

12. Apparatus according to claim 3 including rate control means cooperating with said control means for changing the value of said predetermined number of each of said groups successively developed at a desired time for changing the rate of decay of said amplitude modulated representation.

13. Apparatus according to claim 1 wherein said musical instrument includes a player operated key, said control means including means responsive to depression of said key for causing said output staircase signal to increase to a peak level and to remain at said peak level as long as said key is depressed, said control means causing said output staircase signal to decay from said peak level in response to release of said key.

14. Apparatus according to claim 1 wherein said musical instrument includes a player operated key, said control means including means responsive to depression of said key for causing said output staircase signal to increase to a peak level and to, substantially immediately after achieving said peak level, decay toward a zero level.

15. In an electronic musical instrument of the type having means developing a sequence of binary waveform samples representing a musical waveform signal, apparatus for imposing an envelope on said sequence of waveform samples comprising:

scaling means operable for developing scaled representations of said binary waveform samples of the form $A/2^n$, where A represents the magnitude of a waveform sample and n is an integer;

means for programming said scaling means for developing, in response to each of said waveform samples, a group of said scaled representations $A/2^m$, $A2^{m+1}$. . . $A/2^{m+p}$, were p is a predetermined integer and m is an integer changing by one at selected time intervals;

means for selectively enabling said scaling means for developing said scaled representations such that the sum of the scaled representations of each of said groups differs from the sum of the last preceding non-identical one of said groups by the factor $A/2^{m+p}$; and output means responsive to said scaling means for successively summing the scaled representations forming each of said groups for developing an output signal comprising an amplitude modulated representation of said sequence of waveform samples.

16. Apparatus according to claim 15 including:

a source of clock pulses; and counting means producing a sequence of incrementally increasing timing signals in response to the development of each of said waveform samples;

said means for enabling comprising a first counter changing state in response to said clock pulses and means responsive to each of said sequences of timing signals for coupling an initial enabling signal followed by, in sequence, the outputs representing the state of said first counter for enabling said scaling means for developing one of said groups.

17. Apparatus according to claim 16 wherein said means for programming comprises a second counter clocked in response to the borrow or carry output of said first counter and means for summing the timing signals forming each of said sequences with the output of said second counter for developing a sequence of program codes programming said scaling means for developing one of said groups.

18. Apparatus according to claim 17 wherein said first counter comprises a down counter and said second counter comprises an up counter whereby, said amplitude modulated representation of said sequence of waveform samples comprises a decaying exponential signal.

19. Apparatus according to claim 17 wherein said first counter comprises an up counter and said second counter comprises a down counter whereby said amplitude modulated representation of said sequence of waveform samples represents the attack portion of a musical signal waveform.

20. Apparatus according to claim 18 wherein said source of clock pulses is operative for developing a stream of clock pulses having a constant repetition rate whereby, said decaying exponential signal assumes a concave inflection.

21. Apparatus according to claim 19 wherein said source of clock pulses is operative for developing a stream of clock pulses having a constant repetition rate whereby, said attack signal assumes a concave exponential inflection.

22. Apparatus according to claim 19 wherein said source of clock pulses is operative for developing a stream of clock pulses whose repetition rate decreases by a factor of two each time said down counter is clocked whereby said attack signal assumes a linear shape.

23. Apparatus according to claim 19 wherein said source of clock pulses is operative for developing a stream of clock pulses whose repetition rate decreases by a factor of four each time said down counter is clocked whereby, said attack signal assumes a convex exponential inflection.

24. Apparatus according to claim 17 including means for presetting the states of said first and second counters for establishing the initial gain of said amplitude modulated representation of said sequence of waveform samples.

25. Apparatus according to claim 14 including compensation means responsive to said presetting means for adjusting the repetition rate of said clock pulses for causing said amplitude modulated sequence of waveform samples to decay in a predetermined time interval independent of said initial gain.

26. Apparatus according to claim 17 including rate control means for selectively changing the repetition rate of said clock pulses for correspondingly changing the rate of decay of said amplitude modulated sequence of waveform samples.

27. Apparatus for amplitude modulating a plurality of sequentially generated binary waveform samples comprising:

scaling means operable for developing a plurality of different scaled representations of each of said binary waveform samples, said scaling means having a data input connected for receiving said sequentially generated binary waveform samples, a program input and an enable input;

first means for repetitively developing and coupling a sequence of enabling signals to said scaling means enable input, each of said sequences of enabling signals comprising a plurality of logic bits representing a binary number whose value changes by unity at selected time intervals;

second means for repetitively developing and coupling a sequence of programming signals to said scaling means program input, each of the sequences of programming signals being identical to each other for a predetermined time interval, said programming signals of each of said sequences comprising an incrementally changing multibit logic signal; and output means for developing an output signal representing the sum of the scaled representations developed by said scaling means in response to each of said sequences of enabling signals.

28. Apparatus according to claim 27 wherein said output means comprises a binary adder having first and second inputs and an output, a gate connected to the output of said adder and enabled concurrently with each except the last of said enabling signals of each sequence thereof, a latch clocked for storing the output of said gate in response to each of said enabling signals, means coupling the output of said scaling means and the output of said latch to the first and second inputs of said adder and an output latch clocked for storing the output of said adder in response to the last of said enabling signals of each sequence thereof, the output of said output latch comprising said output signal.

29. Apparatus according to claim 28 wherein said output means includes a digital to analog converter connected for converting said output signal to a corresponding analog form.

30. Apparatus according to claim 27 wherein said first means comprises:

a source of clock pulses;

means repetetively generating an incrementally changing timing signal;

a first multibit binary counter clocked in response to said clock pulses; and gate means responsive to each repetition of said timing signals for developing a serial stream of data bits comprising a logical 1 data bit followed by a plurality of data bits reflecting the state of said first multibit counter, each of said serial streams of data bits comprising one of said sequences of enabling signals.

31. Apparatus according to claim 30 wherein said second means comprises:

a second multibit binary counter clocked in response to the borrow or carry output of said first counter; and a binary adder developing an output summation signal reflecting the sum of said timing signal and the state of said second counter, said output summation signal developed in response to each repetition of said timing signal comprising one of said sequences of programming signals.

32. Apparatus according to claim 31 including means for selectively developing a segment gain code and third means for coupling said segment gain code to said binary adder for controlling the gain of said output signal.

33. Apparatus according to claim 32 including means for selectively developing a step gain code and fourth means responsive to said step gain code for changing the logical characteristics of said sequences of enabling signals for controlling the gain of said output signal.

34. Apparatus according to claim 33 including means responsive to said step and segment codes for coupling newly selected values thereof to said third and fourth means in an incrementally changing manner.

35. A method of imposing an envelope in the form of a multistep staircase signal on a plurality of sequentially generated binary waveform samples comprising the steps of:

deriving a first continuous segment of said multistep staircase signal by developing a group of scaled representations of each of a first series of successively generated ones of said waveform samples, each of said groups associated with a waveform sample of said first series representing the product of a selected waveform sample of said first series and a multiplication factor which is allowed to change in increments representing a first constant amount; and deriving a second continuous segment of said multistep staircase signal contiguous with said first segment by developing a group of scaled representations of each of a second series of successively generated ones of said waveform samples, each of said groups associated with a waveform sample of said second series representing the product of a selected waveform sample of said second series and a multiplication factor which is allowed to change in increments representing a second constant amount, said first constant amount being related to said second constant amount by a predetermined factor;

whereby said first and second segments of said multistep staircase signals comprise an envelope imposed on said sequentially generated binary waveform samples.

36. The method of claim 35 wherein said predetermined factor comprises $2^n$, where n is a non-zero value positive or negative integer.

37. The method of claim 36 including the step of deriving a plurality of additional contiguous segments of said multistep staircase signal, each of said additional segments being derived by developing a group of scaled representations of each of the binary waveform samples of an additional series of successively generated ones of said waveform samples, each of said groups associated with a waveform sample of one of said additional series representing the product of a selected waveform sample of the respective series and a multiplication factor which is allowed to change in increments representing a predetermined constant amount, the predetermined constant amounts associated with successive ones of said additional series being related by said predetermined factor.

38. The method of claim 37 wherein each of said deriving steps comprises the step of developing said selected scaled representations of each of said groups in a sequential manner.

39. The method of claim 37 wherein each of said deriving steps comprises the step of simultaneously developing the selected scaled representations of each of said groups.

* * * * *